US011830414B2

(12) United States Patent
Park

(10) Patent No.: US 11,830,414 B2
(45) Date of Patent: Nov. 28, 2023

(54) DISPLAY DEVICE

(71) Applicant: LG DISPLAY CO., LTD., Seoul (KR)

(72) Inventor: SangHyun Park, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/864,807

(22) Filed: Jul. 14, 2022

(65) Prior Publication Data

US 2023/0046059 A1 Feb. 16, 2023

(30) Foreign Application Priority Data

Aug. 10, 2021 (KR) ..... 10-2021-0105623

(51) Int. Cl.

| | |
|---|---|
| ***G09G 3/20*** | (2006.01) |
| ***G09G 3/3266*** | (2016.01) |
| ***G09G 3/3291*** | (2016.01) |
| ***G09G 3/3233*** | (2016.01) |

(52) U.S. Cl.

CPC ..... *G09G 3/2096* (2013.01); *G09G 3/3233* (2013.01); *G09G 3/3266* (2013.01); *G09G 3/3291* (2013.01); *G09G 2300/0426* (2013.01); *G09G 2300/0819* (2013.01); *G09G 2300/0842* (2013.01); *G09G 2310/0294* (2013.01); *G09G 2330/021* (2013.01); *G09G 2330/028* (2013.01)

(58) Field of Classification Search

None

See application file for complete search history.

(56) References Cited

U.S. PATENT DOCUMENTS

2015/0123953 A1* 5/2015 Shim ..... G09G 3/3233 345/205

* cited by examiner

*Primary Examiner* — Christopher J Kohlman

(74) *Attorney, Agent, or Firm* — POLSINELLI PC

(57) ABSTRACT

A display device comprises a display panel including a plurality of data lines, a plurality of gate lines, a plurality of subpixels, and a plurality of reference voltage lines electrically connected with the plurality of subpixels, each of the plurality of subpixels including a driving transistor and a light emitting element and a gate driving circuit configured to supply a gate signal to the plurality of gate lines, wherein there are three or more periods during which a voltage change slope of a reference voltage line electrically connected with any one subpixel of the plurality of subpixels is decreased and then restored while the gate driving circuit applies the gate signal of a turn-on level voltage to the any one subpixel, thereby reducing the voltage level of the high-potential driving voltage applied to the display panel, to the minimum.

20 Claims, 11 Drawing Sheets

| SW1 | SW2 | SW3 | EVDD_out |
|---|---|---|---|
| 0 | 0 | 0 | EVDD_1 |
| 0 | 0 | 1 | EVDD_2 |
| 0 | 1 | 0 | EVDD_3 |
| 0 | 1 | 1 | EVDD_4 |
| 1 | 0 | 0 | EVDD_5 |
| 1 | 0 | 1 | EVDD_6 |
| 1 | 1 | 0 | EVDD_7 |
| 1 | 1 | 1 | EVDD_8 |

DISPLAY DEVICE

CROSS-REFERENCE TO RELATED APPLICATION

This application claims the priority of Korean Patent Application No. 10-2021-0105623, filed on Aug. 10, 2021, which is hereby incorporated by reference in its entirety.

BACKGROUND

Field of the Disclosure

The disclosure relates to a display device.

Description of the Background

As the information society develops, various demands for display devices for displaying images are increasing, and various types of display devices, such as liquid crystal displays (LCDs) and organic light emitting diode (OLED) displays, are used.

Such a display device includes a display panel including a plurality of subpixels, and a high-potential driving voltage EVDD is applied to the display panel to drive the plurality of subpixels.

Meanwhile, such a high-potential driving voltage EVDD is applied, at a high voltage level, to the display panel. A need exists for a scheme for properly decreasing the voltage level of the high-potential driving voltage EVDD and supplying it to the display panel.

SUMMARY

Accordingly, the present disclosure is to provide a display device that can decrease the voltage level of a high-potential driving voltage and supplies it to the display panel.

In various aspects of the disclosure, a display device comprise a display panel including a plurality of gate lines, a plurality of subpixels and a plurality of reference voltage lines electrically connected with the plurality of subpixels, each of the plurality of subpixels including a driving transistor and a light emitting element and a gate driving circuit configured to supply a gate signal to the plurality of gate lines, wherein there are three or more periods during which a voltage change slope of a reference voltage line electrically connected with any one subpixel of the plurality of subpixels is decreased and then restored while the gate driving circuit applies the gate signal of a turn-on level voltage to the any one subpixel.

In various aspects of the disclosure, a display device comprises a display panel including a plurality of subpixels, each of the plurality of subpixels including a driving transistor and a light emitting element and a driving circuit configured to drive the display panel, wherein the driving circuit includes a raw high-potential driving voltage input terminal to which a raw high-potential driving voltage is input, a high-potential driving voltage output terminal outputting a high-potential driving voltage to the display panel and outputting the high-potential driving voltage having a voltage level lower than the raw high-potential driving voltage, a driving voltage via line electrically connecting the raw high-potential driving voltage input terminal with the high-potential driving voltage output terminal, a reference resistor positioned on the driving voltage via line, a resistor unit electrically connected with the driving voltage via line, a switching unit configured to switch an electrical connection between the resistor unit and a low-potential power source, and a controller configured to control the switching unit.

In various aspects of the disclosure, a display device comprises a display panel; a controller for controlling a data driving circuit and a gate driving circuit of the display panel, wherein the controller is mounted on a control printed circuit board; and a set board electrically connected with the control printed circuit board, wherein a main power management circuit for managing overall power of the display device is disposed on the set board, wherein the control printed circuit board includes a raw high-potential driving voltage input terminal and a high-potential driving voltage output terminal, a raw high-potential driving voltage output from the set board is input to the raw high-potential driving voltage input terminal, and the high-potential driving voltage output terminal outputs a high-potential driving voltage to the display panel, and the controller controls the main power management circuit to reduce voltage level of the raw high-potential driving voltage output from the set board.

According to various aspects of the present disclosure, there can be provided a display device that can decreases the voltage level of a high-potential driving voltage and supplies it to the display panel.

BRIEF DESCRIPTION OF THE DRAWINGS

The above and other features and advantages of the present disclosure will be more clearly understood from the following detailed description, taken in conjunction with the accompanying drawings, in which.

DETAILED DESCRIPTION

Figure 1:
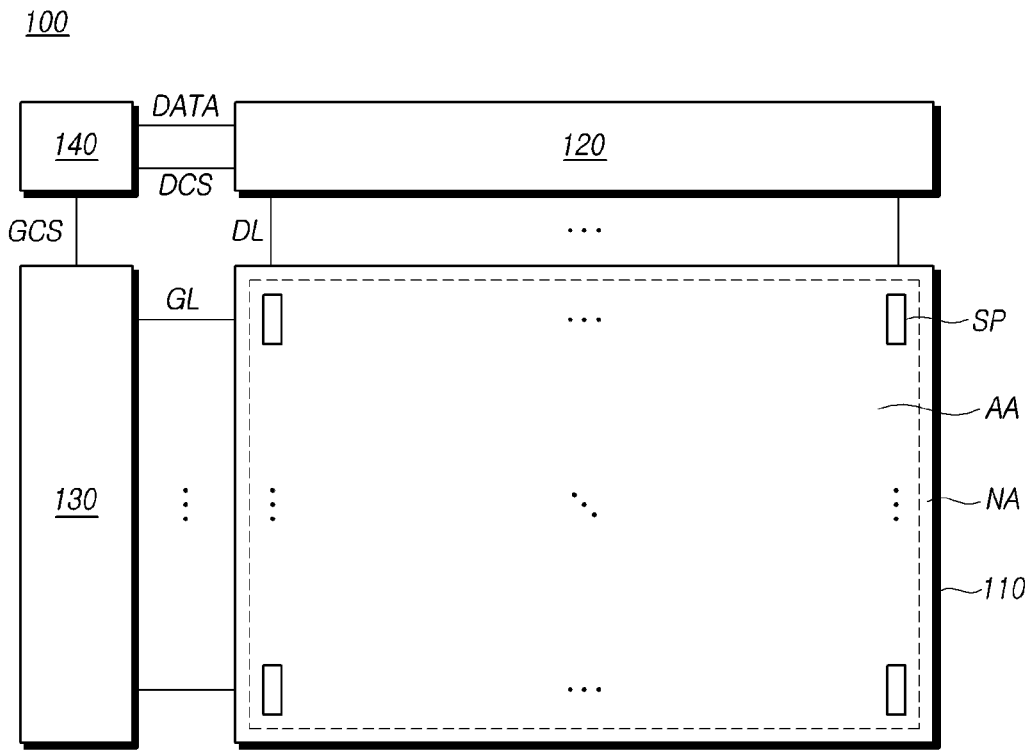
FIG. 1 is a view illustrating a display device according to the disclosure.

In the following description of examples or aspects of the present disclosure, reference will be made to the accompanying drawings in which it is shown by way of illustration specific examples or aspects that can be implemented, and in which the same reference numerals and signs can be used to designate the same or like components even when they are shown in different accompanying drawings from one another. Further, in the following description of examples or aspects of the present disclosure, detailed descriptions of well-known functions and components incorporated herein will be omitted when it is determined that the description may make the subject matter in some aspects of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

Hereinafter, various aspects of the disclosure are described in detail with reference to the accompanying drawings.

FIG. 1 is a view illustrating a display device 100 according to the disclosure.

Referring to FIG. 1, a display device 100 according to the disclosure may include a display panel 110, a data driving circuit 120 and a gate driving circuit 130 for driving the display panel 110, and a controller 140 for controlling the data driving circuit 120 and the gate driving circuit 130.

In the display panel 110, signal lines, such as a plurality of data lines DL and a plurality of gate lines GL, may be disposed on a substrate. In the display panel 110, a plurality of subpixels SP connected with the plurality of data lines DL and the gate lines GL may be disposed.

The display panel 110 may include a display area AA in which images are displayed and a non-display area NA in which no image is displayed. In the display panel 110, a plurality of subpixels SP for displaying an image may be disposed in the display area AA and, in the non-display area NA, the data driving circuit 120 and the gate driving circuit 130 may be mounted, or pad units connected with the data driving circuit 120 or the gate driving circuit 130 may be disposed.

The data driving circuit 120 is a circuit configured to drive the plurality of data lines DL, and may supply data voltages to the plurality of data lines DL. The gate driving circuit 130 is a circuit configured to drive the plurality of gate lines GL, and may supply gate signals Vgate to the plurality of gate lines GL. The controller 140 may supply a data driving timing control signal DCS to the data driving circuit 120 to control the operation timing of the data driving circuit 120. The controller 140 may supply a gate driving timing control signal GCS for controlling the operation timing of the gate driving circuit 130 to the gate driving circuit 130.

The controller 140 may start scanning according to a timing implemented in each frame, convert input image data input from the outside into image data DATA suited for the data signal format used in the data driving circuit 120, supply the image data DATA to the data driving circuit 120, and control data driving at an appropriate time suited for scanning.

The controller 140 receives, from the outside (e.g., a host system), various timing signals including a vertical synchronization signal Vsync, a horizontal synchronization signal Hsync, an input data enable signal DE, and a clock signal, along with the input image data.

To control the data driving circuit 120 and the gate driving circuit 130, the controller 140 receives timing signals, such as the vertical synchronization signal Vsync, horizontal synchronization signal Hsync, input data enable signal DE, and clock signal CLK, generates various control signals DCS and GCS, and outputs the control signals to the data driving circuit 120 and the gate driving circuit 130.

To control the gate driving circuit 130, the controller 140 outputs various gate driving timing control signals GCS including a gate start pulse GSP, a gate shift clock GSC, and a gate output enable signal GOE.

To control the data driving circuit 140, the controller 140 outputs various data driving timing control signals DCS including, e.g., a source start pulse SSP and a source sampling clock.

The data driving circuit 120 receives the image data DATA from the controller 140 and drives the plurality of data lines DL.

The data driving circuit 120 may include one or more source driver integrated circuits SDIC.

Each source driver integrated circuit SDIC may be connected with the display panel 110 by a tape automated bonding (TAB) method or connected to a bonding pad of the display panel 110 by a chip on glass (COG) method or may be implemented by a chip on film (COF) method and connected with the display panel 110.

The gate driving circuit 130 may output a gate signal of a turn-on level voltage or a gate signal of a turn-off level voltage according to the control of the controller 140. The gate driving circuit 130 may drive the plurality of gate lines GL by supplying gate signals of the turn-on level voltage to the plurality of gate lines GL.

The gate driving circuit 130 may be connected with the display panel 110 by a tape automated bonding (TAB) method or connected to a bonding pad of the self-emission display panel 110 by a COG or chip on panel (COP) method or may be connected with the display panel 110 according to a COF method.

The gate driving circuit 130 may be formed in a gate in panel (GIP) type, in the non-display area NA of the display panel 110. The gate driving circuit 130 may be disposed on the substrate of the display panel 110 or may be connected to the substrate of the display panel 110. The gate driving circuit 130 that is of a GIP type may be disposed in the non-display area NA of the substrate. The gate driving circuit 130 that is of a chip-on-glass (COG) type or chip-on-film (COF) type may be connected to the substrate of the display panel 110.

When a specific gate line GL is opened by the gate driving circuit 130, the data driving circuit 120 may convert the image data DATA received from the controller 140 into an analog data voltage and supply it to the plurality of data lines DL.

The data driving circuit 120 may be connected with one side (e.g., an upper or lower side) of the display panel 110. Depending on the driving scheme or the panel design scheme, the data driving circuit 120 may be connected with both sides (e.g., upper and lower sides) of the self-emission display panel 110, or two or more of the four sides of the self-emission display panel 110.

The gate driving circuit 130 may be connected with one side (e.g., a left or right side) of the display panel 110. Depending on the driving scheme or the panel design scheme, the gate driving circuit 130 may be connected with both sides (e.g., left and right sides) of the display panel 110, or two or more of the four sides of the display panel 110.

The controller 140 may be a timing controller used in typical display technology, a control device that may perform other control functions as well as the functions of the timing controller, or a control device other than the timing controller, or may be a circuit in the control device. The controller 140 may be implemented as various circuits or electronic components, such as an integrated circuit (IC), a field programmable gate array (FPGA), an application specific integrated circuit (ASIC), or a processor.

The controller 140 may be mounted on a printed circuit board or a flexible printed circuit and may be electrically connected with the data driving circuit 120 and the gate driving circuit 130 through the printed circuit board or the flexible printed circuit.

The controller 140 may transmit/receive signals to/from the data driving circuit 120 according to one or more predetermined interfaces. The interface may include, e.g., a low voltage differential signaling (LVDS) interface, an EPI interface, and a serial peripheral interface (SPI).

The controller 140 may include a storage medium, such as one or more registers.

The display device 100 according to aspects of the disclosure may be a display including a backlight unit, such as a liquid crystal display, or may be a self-emission display, such as an organic light emitting diode (OLED) display, a quantum dot display, or a micro light emitting diode (LED) display.

According to an aspect, when the display device 100 is an OLED display, each subpixel SP may include an organic light emitting diode (OLED), which is self-luminous, as a light emitting element. According to an aspect, when the display device 100 is a quantum dot display, each subpixel SP may include a light emitting element formed of a quantum dot, which is a self-luminous semiconductor crystal. According to an aspect, when the display device 100 is a micro LED display, each subpixel SP may include a micro light emitting diode, which is self-luminous and formed of an inorganic material, as a light emitting element.

Figure 2:
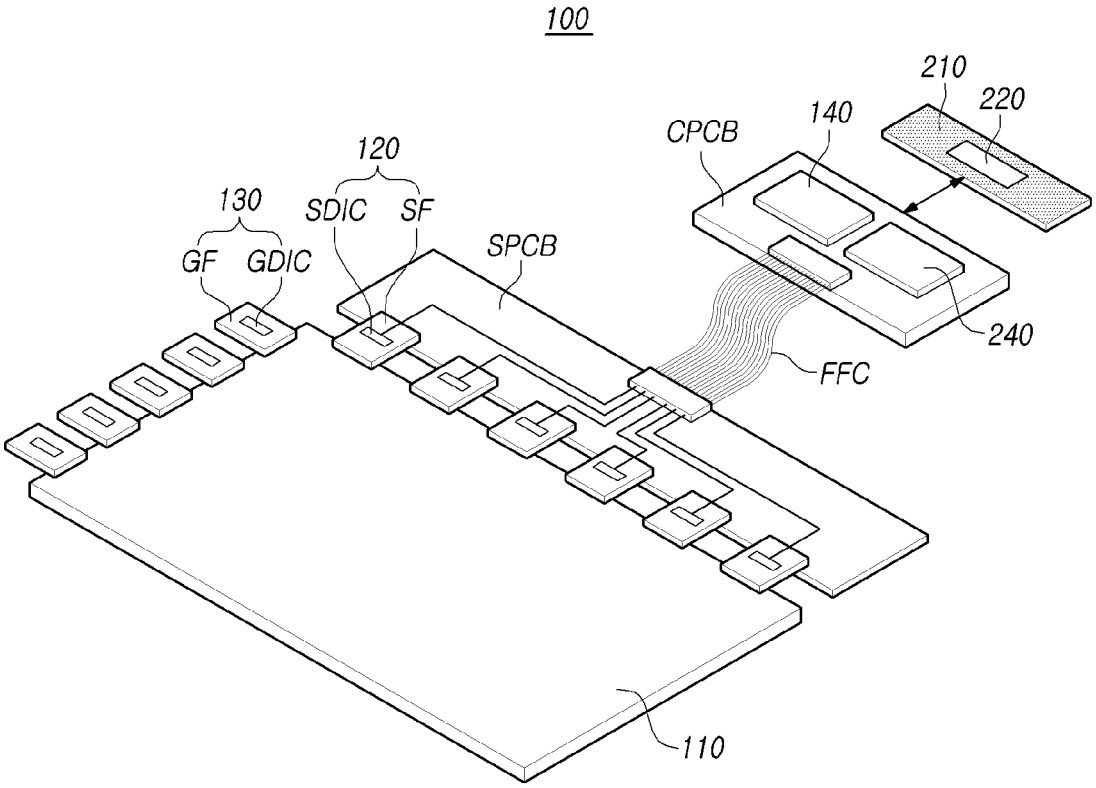
FIG. 2 is a view schematically illustrating a display device according to the disclosure.

FIG. 2 is a view schematically illustrating a display device 100 according to the disclosure.

FIG. 2 illustrates an example in which the data driving circuit 120 in the display device 100 according to the disclosure is implemented in the chip on film (COF) scheme among various schemes (e.g., TAB, COG, or COF).

The data driving circuit 120 may include one or more data driving circuits. The data driving circuit 120 may be implemented as a source driver integrated circuit SDIC. When the data driving circuit 120 is implemented in the chip on film (COF) scheme, the source driver integrated circuit SDIC may be mounted on a source circuit film SF.

One side of the source circuit film SF may be electrically connected with the display panel 110. Lines for electrically connecting the source driver integrated circuit SDIC and the display panel 110 may be disposed on the source circuit film SF.

The display device 100 according to the disclosure may include at least one source printed circuit board SPCB for circuit connection between one or more source driving integrated circuit SDIC and other devices and a control printed circuit board CPCB.

The other side of the source circuit film SF may be electrically connected with the source printed circuit board SPCB.

FIG. 2 illustrates an example in which the gate driving circuit 130 in the display device 100 according to the disclosure is implemented in the chip on film (COF) scheme among various schemes (e.g., TAB, COG, COF, or GIP).

The gate driving circuit 130 may include a gate driver integrated circuit GDIC. When the gate driving circuit 130 is implemented in the chip on film (COF) scheme, the gate driver integrated circuit GDIC may be mounted on a gate circuit film GF.

One side of the gate circuit film GF may be electrically connected with the display panel 110. Lines for electrically connecting the gate driver integrated circuit GDIC and the display panel 110 may be disposed on the gate circuit film GF.

A controller 140 and a power management integrated circuit (PMIC) 240 may be mounted on the control printed circuit board CPCB. The controller 140 may control the data driving circuit 120 and the gate driving circuit 130. The power management integrated circuit 240 may supply a driving voltage or current to the display panel 110, the data driving circuit 120, and the gate driving circuit 130.

At least one source printed circuit board SPCB and the control printed circuit board CPCB may be circuit-connected through at least one connection member. The connection member may be, e.g., a flexible printed circuit FPC or a flexible flat cable FFC.

At least one source printed circuit board SPCB and control printed circuit board CPCB may be integrated into one printed circuit board.

The display device 100 according to the disclosure may further include a set board 210 electrically connected with the control printed circuit board CPCB. A main power management circuit 220 for managing the overall power of the display device 100 may be disposed on the set board 210. The main power management circuit 220 may interwork with the power management integrated circuit 240.

The driving voltage generated by the set board 210 is transferred to the power management integrated circuit 240 in the control printed circuit board CPCB. The power management integrated circuit 240 transfers a driving voltage necessary for driving the display device 100 or sensing characteristic values (e.g., sensing the characteristic values of the subpixels), through the connection member to the source printed circuit board SPCB. The power management integrated circuit 240 may supply a driving voltage to the data driving circuit 120, the gate driving circuit 130, or the display panel 110.

Figure 3:
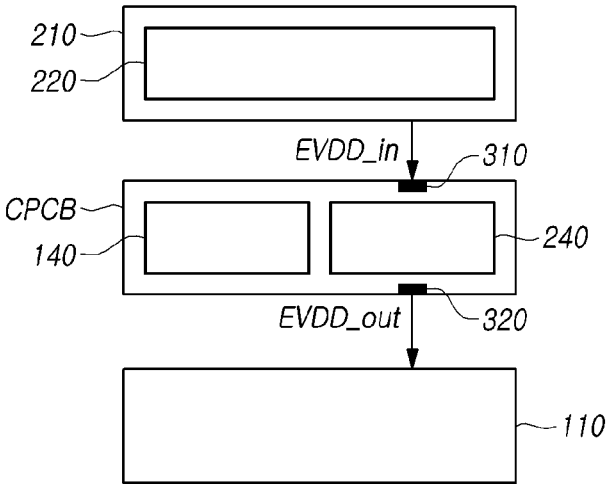
FIG. 3 is a view illustrating an example of a path from output of a raw high-potential driving voltage from a set board to input of a high-potential driving voltage to the display panel.

FIG. 3 is a view illustrating an example of a path from output of a raw high-potential driving voltage EVDD_in from a set board 210 to input of a high-potential driving voltage EVDD_out to the display panel 110.

Referring to FIG. 3, a main power management circuit 220 may be disposed on the set board 210. The main power management circuit 220 may be a circuit that manages the power of the entire display device.

The set board 210 outputs the raw high-potential driving voltage EVDD_in. The raw high-potential driving voltage EVDD_in may be input to the control printed circuit board CPCB.

The raw high-potential driving voltage EVDD_in output from the set board 210 is input to the raw high-potential driving voltage input terminal 310 of the control printed circuit board CPCB.

The control printed circuit board CPCB may include a high-potential driving voltage output terminal 320. A high-potential driving voltage EVDD_out is output from the high-potential driving voltage output terminal 320.

The set board 210 may output the raw high-potential driving voltage EVDD_in having a preset voltage level to drive the display panel 110.

To stably drive the display panel 110, the set board 210 may output a raw high-potential driving voltage EVDD_in having a higher voltage level than a minimum voltage level actually required to drive the display panel 110.

The control printed circuit board CPCB may output the same voltage level of high-potential driving voltage EVDD_out as the input raw high-potential driving voltage EVDD_in from the high-potential driving voltage output terminal 320.

In other words, the high-potential driving voltage EVDD_out securing a sufficient margin is continuously output from the high-potential driving voltage output terminal 320 regardless of the minimum voltage required to drive the display panel 110.

The high-potential driving voltage EVDD_out output from the high-potential driving voltage output terminal 320 may be input to the display panel 110 through the source printed circuit board.

Hereinafter, the high-potential driving voltage EVDD_out input to the display panel 110 is referred to as a driving voltage EVDD.

Figure 4:
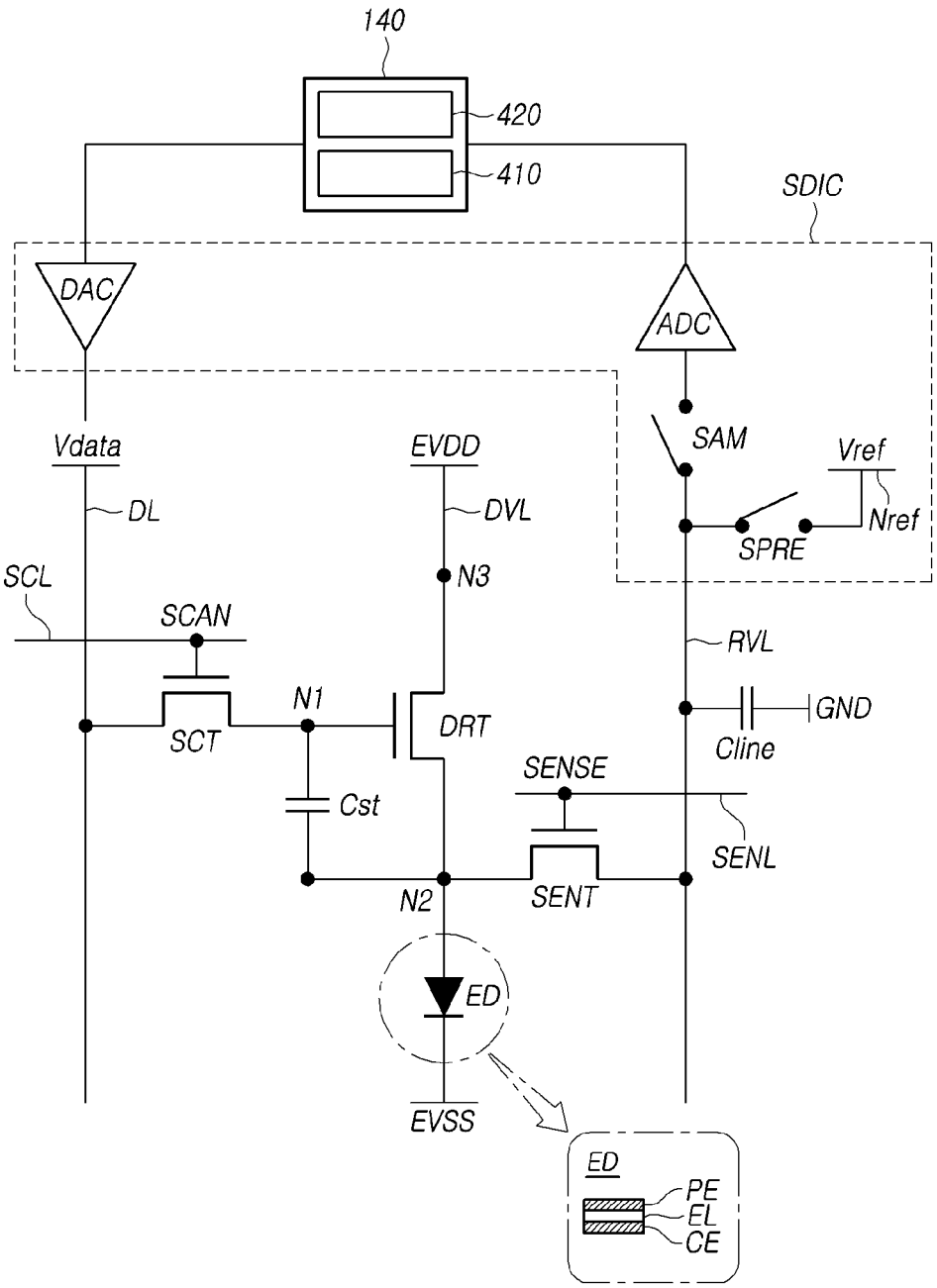
FIG. 4 is a view schematically illustrating an equivalent circuit of a subpixel and a configuration for compensating for characteristic values of the subpixel according to the disclosure.

FIG. 4 is a view schematically illustrating an equivalent circuit of a subpixel SP and a configuration for compensating for characteristic values of the subpixel SP according to the disclosure.

Referring to FIG. 4, each of a plurality of subpixels SP disposed on a display panel 110 of a display device 100 according to the disclosure may include a light emitting element ED, a driving transistor DRT, a scan transistor SCT, and a storage capacitor Cst.

The light emitting element ED may include a pixel electrode PE and a common electrode CE and may include a light emitting layer EL positioned between the pixel electrode PE and the common electrode CE.

The pixel electrode PE of the light emitting element ED may be an electrode disposed in each subpixel SP, and the common electrode CE may be an electrode commonly disposed in all the subpixels SP. Here, the pixel electrode PE may be an anode electrode, and the common electrode CE may be a cathode electrode. Conversely, the pixel electrode PE may be a cathode electrode, and the common electrode CE may be an anode electrode.

For example, the light emitting element ED may be an organic light emitting diode (OLED), a light emitting diode (LED), or a quantum dot light emitting element.

The driving transistor DRT is a transistor for driving the light emitting element ED, and may include a first node N1, a second node N2, and a third node N3.

The first node N1 of the driving transistor DRT may be a gate node of the driving transistor DRT, and may be electrically connected with a source node or a drain node of the scan transistor SCT. The second node N2 of the driving transistor DRT may be a source node or a drain node of the driving transistor DRT, and may be electrically connected with a source node or a drain node of the sensing transistor SENT and may also be electrically connected with the pixel electrode PE of the light emitting element ED. The third node N3 of the driving transistor DRT may be electrically connected with a driving voltage line DVL supplying a driving voltage EVDD.

The scan transistor SCT may be controlled by a scan pulse SCAN, which is a type of gate signal, and may be connected between the first node N1 of the driving transistor DRT and the data line DL. In other words, the scan transistor SCT may be turned on or off according to the scan pulse SCAN supplied from the scan line SCL, which is a type of the gate line GL, controlling the connection between the data line DL and the first node N1 of the driving transistor DRT.

The scan transistor SCT may be turned on by the scan pulse SCAN having a turn-on level voltage and transfer the data voltage Vdata supplied from the data line DL to the first node N1 of the driving transistor DRT.

If the scan transistor SCT is an n-type transistor, the turn-on level voltage of the scan pulse SCAN may be a high level voltage. If the scan transistor SCT is a p-type transistor, the turn-on level voltage of the scan pulse SCAN may be a low level voltage.

The storage capacitor Cst may be electrically connected between the first node N1 and second node N2 of the driving transistor DRT. The storage capacitor Cst is charged with the quantity of electric charge corresponding to the voltage difference between both ends thereof and serves to maintain the voltage difference between both ends for a predetermined frame time. Accordingly, during the predetermined frame time, the corresponding subpixel SP may emit light.

Referring to FIG. 4, each of the plurality of subpixels SP disposed on the display panel 110 of the display device 100 may further include a sensing transistor SENT.

The sensing transistor SENT may be controlled by a sense pulse SENSE, which is a type of gate signal, and may be connected between the second node N2 of the driving transistor DRT and the reference voltage line RVL. In other words, the sensing transistor SENT may be turned on or off according to the sense pulse SENSE supplied from the sense line SENL, which is another type of the gate line GL, controlling the connection between the reference voltage line RVL and the second node N2 of the driving transistor DRT.

The second node N2 of the driving transistor DRT is also referred to as a sensing node.

The sensing transistor SENT may be turned on by the sense pulse SENSE having a turn-on level voltage and transfer a reference voltage Vref supplied from the reference voltage line RVL to the second node N2 of the driving transistor DRT. The reference voltage line RVL is also referred to as a sensing line.

The initialization switch SPRE switches an electrical connection between the reference voltage line RVL and the reference voltage supply node Nref. The initialization switch SPRE may include one end electrically connected to the reference voltage line RVL and the other end electrically connected to the reference voltage supply node Nref.

The reference voltage Vref is applied to the reference voltage supply node Nref.

The sensing transistor SENT may be turned on by the sense pulse SENSE having a turn-on level voltage, transferring the voltage of the second node N2 of the driving transistor DRT to the reference voltage line RVL.

If the sensing transistor SENT is an n-type transistor, the turn-on level voltage of the sense pulse SENSE may be a high level voltage. If the sensing transistor SENT is a p-type transistor, the turn-on level voltage of the sense pulse SENSE may be a low level voltage.

The function in which the sensing transistor SENT transfers the voltage of the second node N2 of the driving transistor DRT to the reference voltage line RVL may be used upon driving to sense the characteristic value of the subpixel SP. In this case, the voltage transferred to the reference voltage line RVL may be a voltage for calculating the characteristic value of the subpixel SP or a voltage reflecting the characteristic value of the subpixel SP.

Each of the driving transistor DRT, the scan transistor SCT, and the sensing transistor SENT may be an n-type transistor or a p-type transistor. In aspects of the disclosure, for convenience of description, each of the driving transistor DRT, the scan transistor SCT, and the sensing transistor SENT is an n-type transistor.

The storage capacitor Cst is not a parasitic capacitor (e.g., Cgs or Cgd) which is an internal capacitor existing between the gate node and the source node (or drain node) of the driving transistor DRT, but may be an external capacitor intentionally designed outside the driving transistor DRT.

The scan line SCL and the sense line SENL may be different gate lines GL. In this case, the scan pulse SCAN and the sense pulse SENSE may be separate gate signals, and the on-off timings of the scan transistor SCT and the on-off timings of the sensing transistor SENT in one subpixel SP may be independent. In other words, the on-off timings of the scan transistor SCT and the on-off timings of the sensing transistor SENT in one subpixel SP may be the same or different.

Alternatively, the scan line SCL and the sense line SENL may be the same gate line GL. In other words, the gate node of the scan transistor SCT and the gate node of the sensing transistor SENT in one subpixel SP may be connected with one gate line GL. In this case, the scan pulse SCAN and the sense pulse SENSE may be the same gate signal, and the on-off timings of the scan transistor SCT and the on-off timings of the sensing transistor SENT in one subpixel SP may be identical.

The structure of the subpixel SP shown in FIG. 4 is merely an example, and various changes may be made thereto, e.g., such as including one or more transistors or one or more capacitors.

Although the structure of the subpixel SP is described with reference to FIG. 4 under the assumption that the display device 100 is a self-emission display device, if the display device 100 is a liquid crystal display, each subpixel SP may include a transistor and a pixel electrode.

Referring to FIG. 4, the display device 100 according to the disclosure may include a line capacitor Cline. The line capacitor Cline may be a capacitor element having one end electrically connected to the reference voltage line RVL or may be a parasitic capacitor formed on the reference voltage line RVL.

Referring to FIG. 4, the source driver integrated circuit SDIC may further include an analog-to-digital converter ADC and a sampling switch SAM.

The reference voltage line RVL may be electrically connected to the analog-to-digital converter ADC. The analog-to-digital converter ADC may sense the voltage of the reference voltage line RVL. The voltage sensed by the analog-to-digital converter ADC may be a voltage reflecting the characteristic value of the subpixel SP.

In the disclosure, the characteristic value of the subpixel SP may be a characteristic value of the driving transistor DRT or the light emitting element ED. The characteristic value of the driving transistor DRT may include a threshold voltage and mobility of the driving transistor DRT. The characteristic value of the light emitting element ED may include a threshold voltage of the light emitting element ED.

The analog-to-digital converter ADC may receive an analog voltage, convert it into a digital value, and output it to the controller 140.

The sampling switch SAM may be positioned between the analog-to-digital converter ADC and the reference voltage line RVL. The sampling switch SAM may switch an electrical connection between the reference voltage line RVL and the analog-to-digital converter ADC.

The controller 140 may include a storage unit 410 storing characteristic value information about the subpixel SP and a compensation circuit 420 that performs calculation for compensating for a change in the characteristic value of the subpixel SP based on the information stored in the storage unit 410.

The storage unit 410 may store information for compensating for the characteristic value of the subpixel SP. For example, the storage unit 410 may store information about the threshold voltage and mobility of the driving transistor DRT of each of the plurality of subpixels SP and information about the threshold voltage of the light emitting element ED included in the subpixel SP.

Information about the threshold voltage of the light emitting element ED may be stored in a lookup table LUT.

The compensation circuit 420 calculates the degree of change in the characteristic value of the corresponding subpixel SP based on the characteristic value information about the subpixel SP stored in the storage unit 410 and the digital value received from the analog-to-digital converter ADC. The compensation circuit 420 updates the characteristic value of the subpixel SP stored in the storage unit 410.

The controller 140 compensates for image data by applying the change in the characteristic value of the subpixel SP, calculated by the compensation circuit 420, thereby driving the data driving circuit 120.

The data voltage Vdata reflecting the change in the characteristic value of the subpixel SP may be output to the data line DL through the digital-to-analog converter DAC.

The process of sensing the change in the characteristic value of the subpixel SP and compensating for the same is referred to as a "subpixel characteristic value compensation process."

Figure 5:
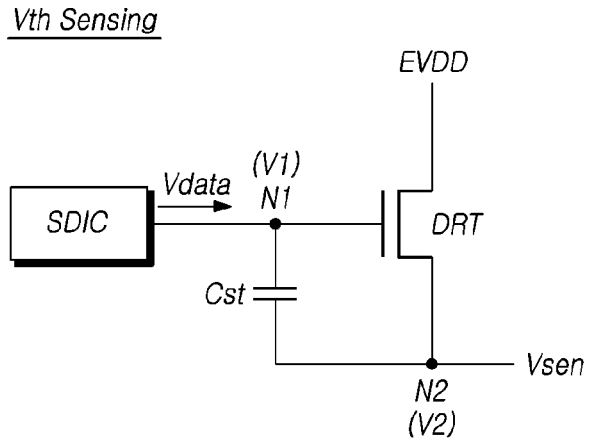
FIG. 5 is a view illustrating a threshold voltage sensing driving scheme for a driving transistor of a display device according to the disclosure.
Figure 5:
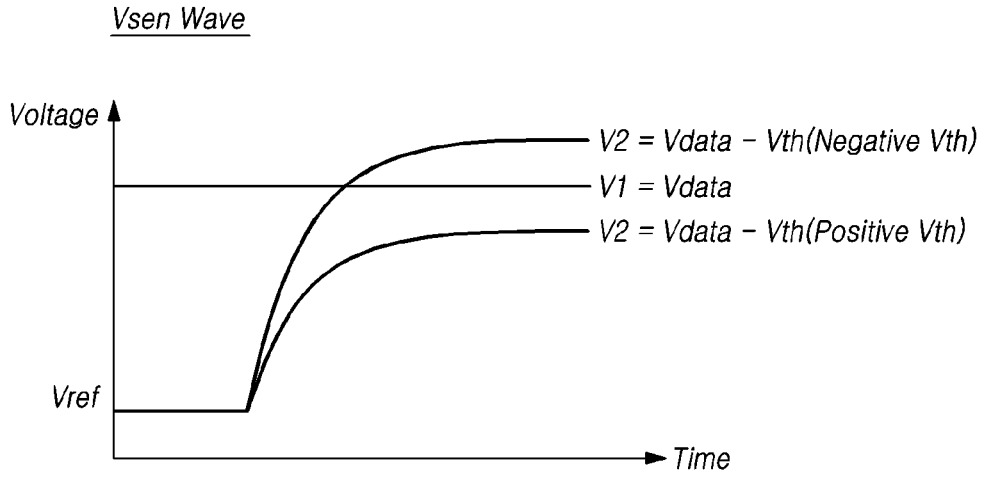

FIG. 5 is a view illustrating a threshold voltage Vth sensing driving scheme for a driving transistor DRT of a display device according to the disclosure.

The threshold voltage sensing driving for the driving transistor DRT may be performed through a sensing process including an initialization step, a tracking step, and a sampling step.

The initialization step is the step of initializing the first node N1 and the second node N2 of the driving transistor DRT.

In the initialization step, the scan transistor SCT and the sensing transistor SENT is turned on, and the initialization switch SPRE is turned on.

Accordingly, the first node N1 and the second node N2 of the driving transistor DRT are initialized as a threshold voltage sensing driving data voltage Vdata and a reference voltage Vref, respectively. (V1=Vdata, V2=Vref)

The tracking step is a step that changes the voltage V2 of the second node N2 of the driving transistor DRT until the voltage of the second node N2 of the driving transistor DRT becomes a voltage state reflecting the threshold voltage or its change.

In other words, the tracking step is the step of tracking the voltage of the second node N2 of the driving transistor DRT that may reflect the threshold voltage or a change thereof.

In the tracking step, the initialization switch SPRE is turned off or the sensing transistor SENT is turned off, so that the second node N2 of the driving transistor DRT is floated.

Accordingly, the voltage of the second node N2 of the driving transistor DRT rises.

The rise of voltage V2 of the second node N2 of the driving transistor DRT gradually slows down, and the voltage V2 is then saturated.

The saturated voltage of the second node N2 of the driving transistor DRT may correspond to the difference between the data voltage Vdata and the threshold voltage Vth or the difference between the data voltage Vdata and the threshold voltage deviation ΔVth.

If the voltage V2 of the second node N2 of the driving transistor DRT is saturated, the sampling step may be performed.

The sampling step is the step of measuring the voltage reflecting the threshold voltage or its change, and the analog-to-digital converter ADC senses the voltage of the reference voltage line RVL, i.e., the voltage V2 of the second node N2 of the driving transistor DRT.

The voltage Vsen sensed by the analog-to-digital converter ADC may be the voltage Vdata_SEN-Vth which is the data voltage Vdata minus the threshold voltage Vth or the voltage Vdata-ΔVth which is the data voltage Vdata minus the threshold voltage deviation ΔVth. Here, Vth may be a positive threshold voltage or a negative threshold voltage.

Figure 6:
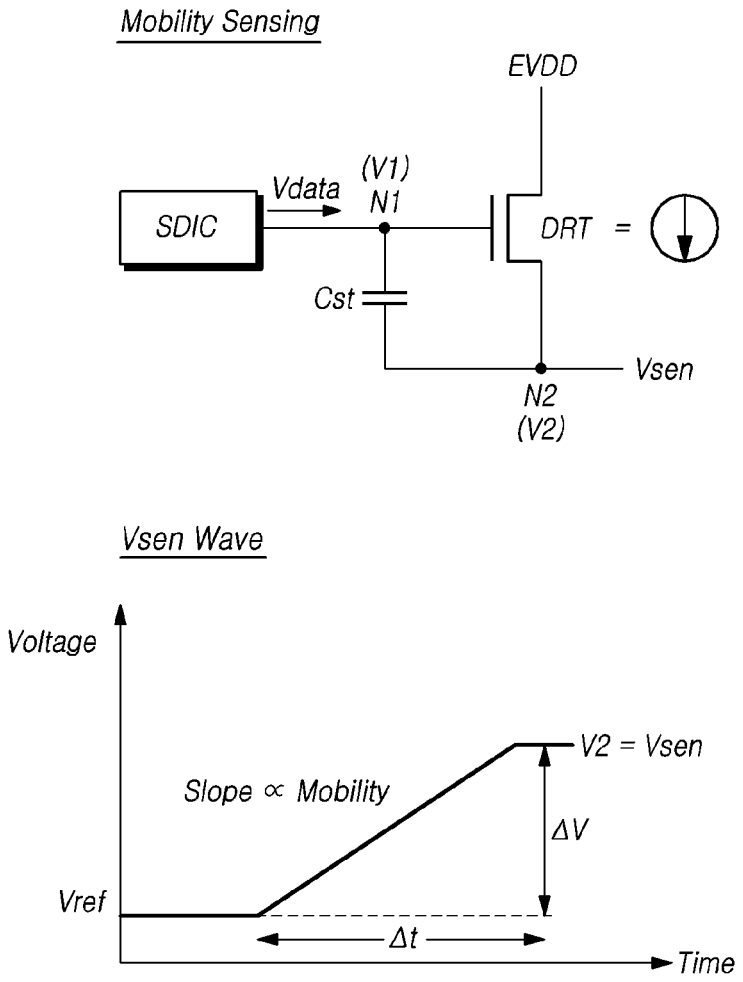
FIG. 6 is a view illustrating a mobility sensing driving scheme for a driving transistor of a display device according to the disclosure.

FIG. 6 is a view illustrating a mobility sensing driving scheme for a driving transistor DRT of a display device according to the disclosure.

The mobility sensing driving for the driving transistor DRT may be performed through a sensing process including an initialization step, a tracking step, and a sampling step.

The initialization step is the step of initializing the first node N1 and the second node N2 of the driving transistor DRT.

In the initialization step, the scan transistor SCT and the sensing transistor SENT is turned on, and the initialization switch SPRE is turned on.

Accordingly, the first node N1 and the second node N2 of the driving transistor DRT are initialized as a mobility sensing driving data voltage Vdata and a reference voltage Vref, respectively. (V1=Vdata, V2=Vref)

The tracking step is a step that changes the voltage V2 of the second node N2 of the driving transistor DRT until the voltage of the second node N2 of the driving transistor DRT becomes a voltage state reflecting the mobility or its change.

In other words, the tracking step is the step of tracking the voltage of the second node N2 of the driving transistor DRT that may reflect the mobility or its change.

In the tracking step, the initialization switch SPRE is turned off or the sensing transistor SENT is turned off, so that the second node N2 of the driving transistor DRT is floated. In this case, the scan transistor SCT may be turned off, so that the first node N1 of the driving transistor DRT may also be floated.

Accordingly, the voltage V2 of the second node N2 of the driving transistor DRT starts to rise.

The rising rate of the voltage V2 of the second node N2 of the driving transistor DRT varies depending on the current capability (i.e., mobility) of the driving transistor DRT.

As the current capability (mobility) of the driving transistor DRT increases, the voltage V2 of the second node N2 of the driving transistor DRT further sharply rises.

After the tracking period proceeds during a predetermined time Δt, i.e., after the voltage V2 of the second node N2 of the driving transistor DRT rises during the preset tracking time Δt, the sampling period may proceed.

During the tracking step, the rising rate of the voltage of the second node N2 of the driving transistor DRT corresponds to a voltage variation ΔV for the predetermined time Δt.

In the sampling step, the sampling switch SAM is turned on, so that the analog-to-digital converter ADC and the reference voltage line RVL are electrically connected.

Accordingly, the analog-to-digital converter ADC senses the voltage of the reference voltage line RVL, i.e., the voltage V2 of the second node N2 of the driving transistor DRT.

The voltage Vsen sensed by the analog-to-digital converter ADC may be the voltage which is the reference voltage Vref plus the voltage variation ΔV during the preset tracking time Δt.

According to the threshold voltage or mobility sensing driving as described above in connection with FIGS. 5 and 6, the analog-to-digital converter ADC converts the voltage Vsen sensed for threshold voltage sensing or mobility sensing into a digital value and generates and outputs sensing data including the digital value (sensing value).

The sensing data output from the analog-to-digital converter ADC may be provided to the compensation circuit 420. In some cases, the sensing data may be provided to the compensation circuit 420 through the storage unit 410.

The compensation circuit 420 may grasp the characteristic value (e.g., threshold voltage or mobility) of the driving transistor DRT in the corresponding subpixel or a change in the characteristic value of the driving transistor DRT (e.g., a change in threshold voltage or a change in mobility) based on the sensing data provided from the analog-to-digital converter ADC and perform a characteristic value compensation process.

The change in the characteristic value of the driving transistor DRT may mean a change in the current sensing data from previous sensing data or a change in the current sensing data from initial compensation data.

Accordingly, it is possible to grasp the characteristic value deviation between driving transistors DRT by comparing characteristic values or changes in characteristic value between the driving transistors DRT. When the change in the characteristic value of the driving transistor DRT means a change in the current sensing data from the initial compensation data, it is possible to grasp the characteristic value deviation (i.e., subpixel luminance deviation) between driving transistors DRT from the change in the characteristic value of the driving transistor DRT.

The initial compensation data may be initial setting data that is set and stored when the display device is manufactured.

The characteristic value compensation process may include threshold voltage compensation processing for compensating for the threshold voltage of the driving transistor DRT and mobility compensation processing for compensating for the mobility of the driving transistor DRT.

The threshold voltage compensation processing may include the processing of calculating compensation data for compensating for the threshold voltage or threshold voltage deviation (change in threshold voltage), storing the calculated compensation data in the storage unit 410, or changing the image data DATA into the calculated compensation data.

The mobility compensation processing may include the processing of calculating compensation data for compensating for the mobility or mobility deviation (change in mobility), storing the calculated compensation data in the storage unit 410, or changing the image data DATA into the calculated compensation data.

The compensation circuit 420 may change the image data DATA through the threshold voltage compensation processing or mobility compensation processing and supply the changed data to the corresponding source driving integrated circuit SDIC in the data driving circuit 120.

Accordingly, the source driving integrated circuit SDIC converts the data changed by the compensation unit 420 into a data voltage through a digital-to-analog converter (DAC) and supplies it to the corresponding subpixel. By so doing, it is possible to indeed achieve compensation for the subpixel characteristic value (threshold voltage compensation or mobility compensation).

The driving voltage EVDD is input to the third node N3 of the driving transistor DRT, and the data voltage Vdata is input to the second node N2. The driving transistor DRT may control the amount of current flowing to the light emitting element ED electrically connected with the driving transistor DRT according to a voltage difference (also referred to as a 'source-gate voltage difference') between the second node N2 and the first node N1.

The driving voltage EVDD has a voltage level capable of operating the driving transistor DRT and driving the light emitting element ED and is supplied to the third node N3 of the driving transistor DRT.

As the driving time elapses, the light emitting element ED is deteriorated, and the voltage level necessary to drive the light emitting element ED increases.

Accordingly, the driving voltage EVDD has a sufficiently larger voltage margin than the voltage level necessary to drive the light emitting element ED and the driving transistor DRT in the initial state and is applied to the driving transistor DRT.

However, such a large voltage margin is unnecessary for driving the display device 100 if the deterioration of the light emitting element ED does not occur. Accordingly, it is necessary to reduce the driving voltage EVDD to an appropriate level.

Figure 7:
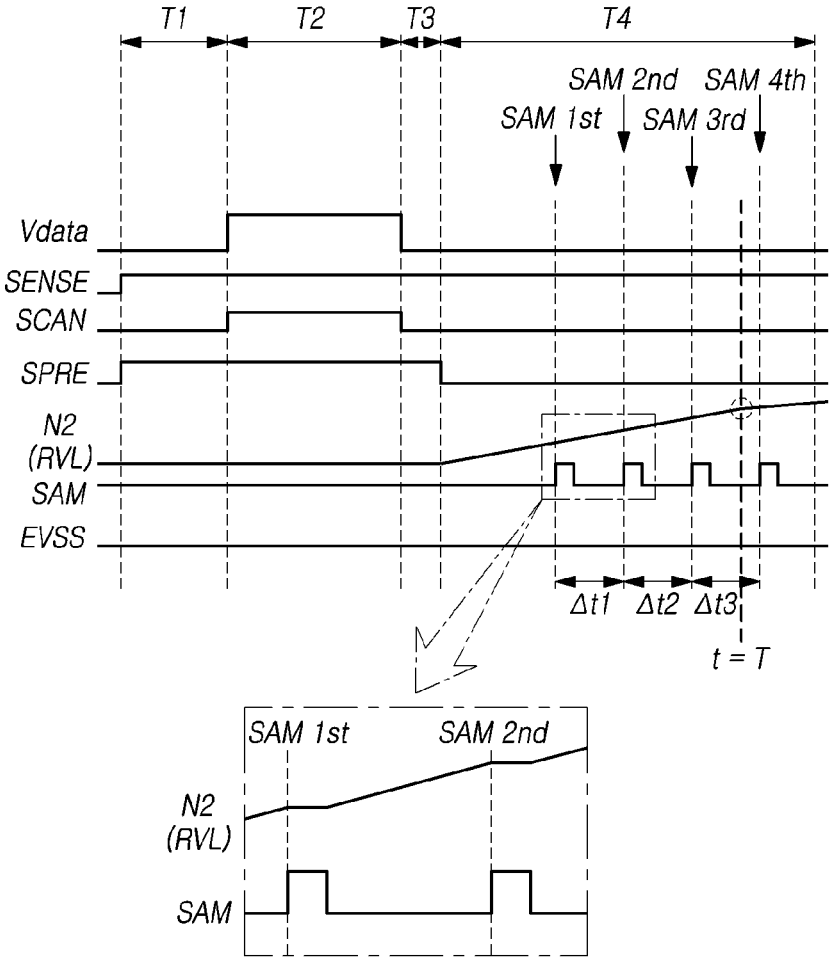
FIG. 7 is a view illustrating a multiple sampling process MSP for producing an appropriate level of driving voltage EVDD in a display device according to the disclosure.

FIG. 7 is a view illustrating a multiple sampling process MSP for producing an appropriate level of driving voltage EVDD_in a display device 100 according to the disclosure.

Referring to FIG. 7, the display device 100 may perform a multiple sampling process MSP on one subpixel SP.

The multi-sampling process MSP may be an off-sensing process that is performed before an off-sequence, such as power-off, is performed.

When the above-described threshold voltage sensing driving is performed as an off-sensing process that is performed before an off-sequence, such as power-off, is performed, the multiple sampling process MSP may be performed on the subpixel SP where the threshold voltage sensing driving is not performed.

The multiple sampling process MSP may include a first period to a fourth period T1 to T4. The first to fourth periods T1 to T4 may be divided depending on operation timings of a circuit element included in the subpixel SP.

During the first to fourth periods T1 to T4, the pre-change driving voltage EVDDold is applied to the third node N3 of the driving transistor DRT.

In the following description, it is assumed that the first node N1 of the driving transistor DRT is the gate node of the driving transistor DRT, the second node N2 of the driving transistor DRT is the source node of the driving transistor DRT, and the third node N3 is the drain node of the driving transistor DRT.

During the first period T1, a sense pulse SENSE of a turn-on level voltage is applied to the sensing transistor SENT, and the initialization switch SPRE is turned on. The reference voltage Vref is applied to the reference voltage line RVL, and the second node N2 of the driving transistor DRT is initialized to the reference voltage Vref.

While the sense pulse SENSE of the turn-on level voltage is applied to the sensing transistor SENT, the reference voltage line RVL may reflect a change in the voltage of the second node N2 of the driving transistor DRT.

During the first period T1, a scan pulse SCAN of a turn-off level voltage may be applied to the scan transistor SCT.

During the second period T2, the data voltage Vdata is applied to the data line DL, and the scan pulse SCAN of the turn-on level voltage is applied to the scan transistor SCT. The data voltage Vdata may be a voltage level for the multiple sampling process. The voltage of the first node N1 of the driving transistor DRT may be initialized to the data voltage Vdata for the multiple sampling process.

During the second period T2, the voltage level of the data voltage Vdata applied to the data line DL may be the same as the voltage level of the mobility sensing driving data voltage of the driving transistor DRT.

During the second period T2, the voltage level of the data voltage Vdata applied to the data line DL may be higher than the voltage level of the threshold voltage sensing driving data voltage of the driving transistor DRT.

During the second period T2, a direct current (DC) voltage is applied to the data line DL. The data voltage Vdata applied to the data line DL during the second period T2 may have a different waveform from the alternating current (AC) data voltage Vdata applied to the data line DL for image display during the image display period.

During the second period T2, the voltage of the first node N1 of the driving transistor DRT is initialized to the data voltage Vdata for the multiple sampling process, and the voltage of the second node N2 of the driving transistor DRT is initialized to the reference voltage Vref.

During the third period T3, a scan pulse SCAN of a turn-off level voltage may be applied to the scan transistor SCT. The voltage supplied from the storage capacitor Cst is applied to the first node N1 of the driving transistor DRT.

During the fourth period T4, the initialization switch SPRE is turned off. During the fourth period T4, the sense pulse SENSE of the turn-on level voltage is applied to the sensing transistor SENT.

During the fourth period T4, the driving transistor DRT is turned on, the second node N2 of the driving transistor DRT is floated, and the voltage of the second node N2 of the driving transistor DRT is gradually increased from the reference voltage Vref.

The voltage of the second node N2 of the driving transistor DRT may be constantly changed according to time t until a specific time t=T. In other words, the variation in the voltage of the second node N2 of the driving transistor DRT over time t may be constant until the specific time t=T. Until the specific time t=T, the variation in the voltage of the second node N2 of the driving transistor DRT per unit time may be constant.

After the specific time t=T, the variation in the voltage of the second node N2 of the driving transistor DRT per unit time may be reduced as compared to before the specific time t=T.

In other words, from the specific point t=T, the slope of the voltage change (e.g., voltage rise or voltage drop) of the second node N2 of the driving transistor DRT per unit time may decrease.

Before the specific time t=T, the driving transistor DRT may be driven in a saturation region.

After the specific time t=T, the driving transistor DRT may be driven in a triode region.

The analog-to-digital converter ADC may sample the voltage of the second node N2 of the driving transistor DRT three or more times during the fourth period T4.

The sampling switch SAM switches an electrical connection between the reference voltage line RVL and the analog-to-digital converter ADC. The sampling switch SAM may be switched three or more times during the fourth period T4.

Accordingly, during the fourth period T4, there may be three or more times when the voltage rise of the reference voltage line RVL electrically connected to the second node N2 of the driving transistor DRT stops.

During the fourth period T4, the voltage rise of the reference voltage line RVL electrically connected to the second node N2 of the driving transistor DRT may be resumed after stopped three or more times. Referring to FIG. 7, the sampling switch SAM may be switched four times during the fourth period T4.

The sampling switch SAM is turned on at a first sampling time SAM 1st, and the analog-to-digital converter ADC receives the analog voltage of the second node N2 of the driving transistor DRT.

The analog-to-digital converter ADC converts the analog voltage input at the first sampling time SAM 1st into a digital value and outputs it to the controller 140.

Referring to FIG. 7, the voltage of the reference voltage line RVL may rise with a constant slope until immediately before the first sampling time SAM 1st.

According to the operation of the sampling switch SAM, the voltage change slope of the reference voltage line RVL may be decreased and then restored. In aspects of the present disclosure, the voltage change may include a voltage rise or a voltage drop (voltage falling). However, for convenience of description, the voltage change is described in terms of voltage rise. In this regard, in aspects of the present disclosure, the voltage change slope may include a voltage rising slope or a voltage falling slope. However, for convenience of description, the voltage change slope is described in terms of the voltage rising slope.

When the sampling switch SAM is turned on, the voltage change slope of the reference voltage line RVL may be reduced.

When the sampling switch SAM is turned off, the voltage change slope of the reference voltage line RVL may be restored to the same value as the voltage change slope of the reference voltage line RVL before the sampling switch SAM is turned on.

During the period in which the sense pulse SENSE of the turn-on level voltage as the gate signal Vgate is input to the subpixel SP, the voltage change slope of the second node N2 of the driving transistor DRT may be applied to the reference voltage line RVL.

In the following description, it is assumed that the voltage change slope of the reference voltage line RVL electrically connected with the subpixel SP during the period when the gate signal Vgate of the turn-on level voltage is input to the subpixel SP means the voltage change slope of the second node N2 of the driving transistor DRT of the subpixel SP during the period when the sense pulse SENSE of the turn-on level voltage is input.

Specifically, it is assumed that the voltage change slope of the second node N2 of the driving transistor DRT in the subpixel SP during the fourth period T4 means the voltage change slope of the reference voltage line RVL electrically connected with the subpixel SP during the fourth period T4.

According to the turn-on and turn-off of the sampling switch SAM, the voltage change slope of the reference voltage line RVL is decreased and then restored. This may be distinguished from the characteristic that as the driving region of the driving transistor DRT changes from the saturation region to the triode region, the voltage change slope of the reference voltage line RVL is decreased and is not restored.

The driving region of the driving transistor DRT is described below.

The voltage waveform of the reference voltage line RVL immediately after the first sampling time SAM 1st may differ from the waveform of the reference voltage line RVL immediately before the first sampling time SAM 1st.

The moment that the sampling switch SAM is turned on, the reference voltage line RVL electrically connected to one end of the sampling switch SAM may be electrically connected with the other end of the sampling switch SAM. The charge stored in the line capacitor Cline electrically connected with the reference voltage line RVL may flow to the other end of the sampling switch SAM.

Accordingly, if the sampling switch SAM is turned on, the voltage rise of the reference voltage line RVL temporarily stops at the time when the sampling switch SAM is turned on.

The voltage of the reference voltage line RVL may rise again according to the time when the sampling switch SAM is turned off or may rise again even when the sampling switch SAM is turned off.

When the voltage rise of the reference voltage line RVL is stopped and then resumed, the voltage level rise width per unit time of the reference voltage line RVL may be equal to that before the voltage rise is stopped.

In other words, the rise width of the voltage level per unit time of the reference voltage line RVL during a predetermined period before the voltage rise is temporarily stopped may be equal to the rise width of the voltage level per unit time of the reference voltage line RVL during a predetermined period after the voltage rise is resumed.

In other words, the voltage change slope of the reference voltage line RVL after the voltage rise is resumed may be equal to the voltage change slope of the reference voltage line RVL before the voltage rise is temporarily stopped.

Referring to FIG. 7, the voltage of the reference voltage line RVL rises during the fourth period T4, the voltage rise temporarily stops at the first sampling time SAM 1st, and then, the voltage rise of the reference voltage line RVL is resumed.

The rise width of the voltage level per unit time of the reference voltage line RVL during a predetermined period before the first sampling time SAM 1st is equal to the rise width of the voltage level per unit time of the reference voltage line RVL during a predetermined period after the voltage rise, which is stopped at the first sampling time SAM 1st, is resumed.

In other words, the voltage rise width per unit time of the reference voltage line RVL before the voltage rise of the reference voltage line RVL is stopped may be equal to the voltage rise width per unit time of the reference voltage line after the voltage rise of the reference voltage line RVL is resumed.

That a voltage rise width is equal to another voltage rise width may mean both that the voltage rise widths are completely the same as other and that the voltage rise widths are the same as each other within an error range.

The sampling switch SAM is turned on at a second sampling time SAM 2nd, and the analog-to-digital converter ADC receives the analog voltage of the second node N2 of the driving transistor DRT.

The analog-to-digital converter ADC converts the analog voltage input at the second sampling time SAM 2nd into a digital value and outputs it to the controller 140.

The controller 140 may calculate the first voltage change slope of the second node N2 of the driving transistor DRT based on the voltage of the second node N2 of the driving transistor DRT, sensed at each sampling timing, and the time interval Δt1 between the first sampling time SAM 1st and the second sampling time SAM 2nd.

The sampling switch SAM is turned on at a third sampling time SAM 3rd, and the analog-to-digital converter ADC receives the analog voltage of the second node N2 of the driving transistor DRT.

The analog-to-digital converter ADC converts the analog voltage input at the third sampling time SAM 3rd into a digital value and outputs it to the controller 140.

The controller 140 may calculate the second voltage change slope of the second node N2 of the driving transistor DRT based on the voltage of the second node N2 of the driving transistor DRT, sensed at each sampling timing, and the time interval Δt2 between the second sampling time SAM 2nd and the third sampling time SAM 3rd.

The controller 140 may compare the calculated second voltage change slope of the second node N2 of the driving transistor DRT with the first voltage change slope of the second node N2 of the driving transistor DRT.

Upon determining that the second voltage change slope of the second node N2 of the driving transistor DRT is equal to the first voltage change slope of the second node N2 of the driving transistor DRT or the difference between the two calculated slopes falls within a preset error range, the controller 140 may determine that the driving region of the driving transistor DRT at a third sampling time SAM 3rd is the saturation region.

Upon determining that the second voltage change slope of the second node N2 of the driving transistor DRT is different from the first voltage change slope of the second node N2 of the driving transistor DRT or the difference between the two calculated slopes falls outside a preset error range, the controller 140 may determine that the driving region of the driving transistor DRT at a third sampling time SAM 3rd is the triode region.

In FIG. 7, the second voltage change slope of the second node N2 of the driving transistor DRT is equal to the first voltage change slope of the second node N2 of the driving transistor DRT and, based thereupon, the controller 140 may determine that the driving region of the driving transistor DRT at the third sampling time SAM 3rd is the saturation region.

The time interval Δt2 between the second sampling time SAM 2nd and the third sampling time SAM 3rd may be equal to the above-described time interval Δt1 between the third sampling time SAM 3rd and the second sampling time SAM 2nd. In this case, the controller 140 may determine whether the driving region of the driving transistor DRT is the saturation region or the triode region by comparing only voltage rises of the second node N2 of the driving transistor DRT.

The sampling switch SAM is turned on at a fourth sampling time SAM 4th, and the analog-to-digital converter ADC receives the analog voltage of the second node N2 of the driving transistor DRT.

The analog-to-digital converter ADC converts the analog voltage input at the fourth sampling time SAM 4th into a digital value and outputs it to the controller 140.

The controller 140 calculates the third voltage change slope of the second node N2 of the driving transistor DRT based on the voltage of the second node N2 of the driving transistor DRT, sensed at each sampling timing, and the time interval Δt3 between the third sampling time SAM 3rd and the fourth sampling time SAM 4th.

The controller 140 may compare the voltage change slope of the second node N2 of the driving transistor DRT with the first voltage change slope of the second node N2 of the driving transistor DRT.

Upon determining that the third voltage change slope of the second node N2 of the driving transistor DRT is equal to the first voltage change slope of the second node N2 of the driving transistor DRT or the difference between the two slopes falls within a preset error range, the controller 140 may determine that the driving region of the driving transistor DRT at the fourth sampling time SAM 4th is the saturation region.

Upon determining that the third voltage change slope of the second node N2 of the driving transistor DRT is different from the first voltage change slope of the second node N2 of the driving transistor DRT or the difference between the two slopes falls outside a preset error range, the controller 140 may determine that the driving region of the driving transistor DRT at the fourth sampling time SAM 4th is the triode region.

In FIG. 7, the voltage change slope of the second node N2 of the driving transistor DRT decreases from a specific time t=T between the third sampling time SAM 3rd and the fourth sampling time SAM 4th. Accordingly, the third voltage change slope of the second node N2 of the driving transistor DRT, calculated based on the voltage of the second node N2 of the driving transistor DRT at the fourth sampling time SAM 4th, is smaller than the first voltage change slope of the second node N2 of the driving transistor DRT. Based thereupon, the controller 140 may determine that the driving region of the driving transistor DRT at the fourth sampling time SAM 4th is the triode region.

Upon determining that the driving region of the driving transistor DRT at the immediately previous sampling time is the saturation region, the controller 140 may compare the voltage change slope of the second node N2 of the driving transistor DRT at the corresponding sampling time with the voltage change slope of the second node N2 of the driving transistor DRT at the immediately previous sampling time. Based on a result of the comparison, the controller 140 may determine whether the driving region of the driving transistor DRT at the corresponding sampling time is the saturation region or the triode region.

For example, the controller 140 may determine whether the driving region of the driving transistor DRT at the third sampling time SAM 3rd is the saturation region as described above. The controller 140 may also compare the voltage change slope of the second node N2 of the driving transistor DRT at the fourth sampling time SAM 4th with the voltage change slope of the driving transistor DRT at the third sampling time SAM 3rd which is the immediately previous sampling time. The controller 140 may compare the third voltage change slope of the second node N2 of the driving transistor DRT with the second voltage change slope of the second node N2 of the driving transistor DRT and, as a result of the comparison, determine that the third voltage change slope is smaller than the second voltage change slope. Based on such comparison result, the controller 140 may determine that the driving region of the driving transistor DRT at the fourth sampling time SAM 4th is the triode region.

Referring to FIG. 7, the voltage change slope of the second node N2 of the driving transistor DRT is varied from a specific time t=T between the third sampling time SAM 3rd and the fourth sampling time SAM 4th.

Accordingly, the controller 140 may determine that the driving transistor DRT is driven in the saturation region at the first sampling time SAM 1st, the second sampling time SAM 2nd, and the third sampling time SAM 3rd, and the driving transistor DRT is driven in the triode region at the fourth sampling time SAM 4th.

The controller 140 may be aware of the last sampling time when the driving transistor DRT is driven in the saturation region, from the voltage value of the second node N2 of the driving transistor DRT obtained at several sampling times.

The controller 140 may store the voltage of the second node N2 of the driving transistor DRT, sensed at the last sampling time when the driving transistor DRT is driven in the saturation region, as a "driving voltage calculation variable."

Referring to FIG. 7, the controller 140 may store the voltage of the second node N2 of the driving transistor DRT, sensed at the third sampling time SAM 3rd of the driving transistor DRT, as the "driving voltage calculation variable."

Figure 8:
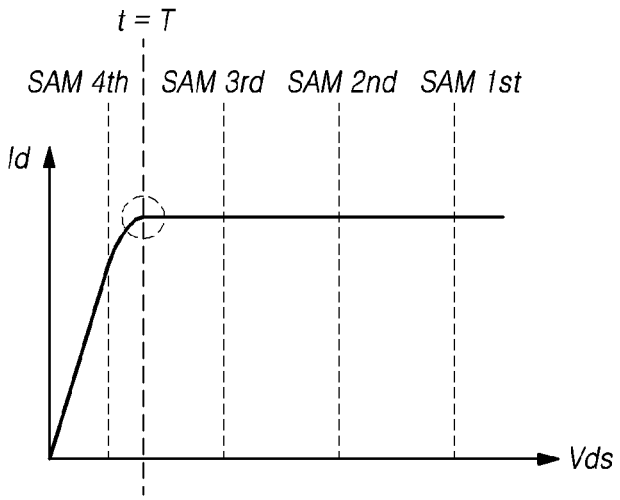
FIG. 8 is a view illustrating an example of a drain voltage Vds and a drain current Id of a driving transistor according to the sampling time of FIG. 7.

FIG. 8 is a view illustrating an example of a drain voltage Vds and a drain current Id of a driving transistor according to the sampling time of FIG. 7.

FIG. 8 illustrates the relationship between the drain voltage Vds and drain current Id of the driving transistor DRT.

Referring to FIGS. 7 and 8, the pre-change driving voltage EVDDold is applied to the third node N3 of the driving transistor DRT, and the voltage of the second node N2 of the driving transistor DRT gradually rises.

Referring to FIG. 8, the drain voltage Vds of the driving transistor DRT gradually decreases from the first sampling time SAM 1st to the third sampling time SAM 3rd, but the drain current Id of the driving transistor DRT remains constant.

As the drain voltage Vds of the driving transistor DRT decreases between the third sampling time SAM 3rd and fourth sampling time SAM 4th, there exists a period during which the drain current Id of the driving transistor DRT increases.

According to this, the drain voltage Vds of the driving transistor DRT at the third sampling time SAM 3rd is the drain voltage Vds at which the driving transistor DRT is driven in the saturation region, and the drain voltage Vds of the driving transistor DRT at the fourth sampling time SAM 4th is the drain voltage Vds at which the driving transistor DRT is driven in the triode region.

Referring to FIG. 8, if the driving transistor DRT is driven in the saturation region, the drain voltage Vds does not affect the drain current Id. Accordingly, the drain current Id may be adjusted by simply adjusting the gate voltage, leading to stable image display.

Thus required is a voltage level of driving voltage EVDD at which the driving voltage EVDD is minimized, and the driving transistor DRT can be driven in the saturation region.

A target driving voltage EVDDgoal for driving the driving transistor DRT in the saturation region based on the voltage of the second node N2 of the driving transistor DRT sampled three or more times is as follows.

$$EVDDgoal = EVDDold - V(\text{driving voltage calculation variable}) + \text{light emitting element driving voltage} \quad \text{[Equation 1]}$$

In Equation 1 above, "EVDDgoal" denotes the minimum driving voltage EVDD for driving the driving transistor DRT in the saturation region and driving the light emitting element ED.

"EVDDold" denotes the driving voltage EVDD previously applied to the third node N3 of the driving transistor DRT while the voltage of the second node N2 of the driving transistor DRT is sampled several times.

"V (driving voltage calculation variable)" denotes the analog voltage value of the second node N2 of the driving transistor DRT at the last sampling time at which the driving transistor DRT is determined to be driven in the saturation region.

"Light emitting element driving voltage" is the voltage value necessary to drive the light emitting element ED. The light emitting element driving voltage may be read from values stored in a lookup table in the controller 140.

In Equation 1, "EVDDold-V (driving voltage calculation variable)" corresponds to the minimum drain voltage Vds for driving the driving transistor DRT in the saturation region.

The controller 140 may calculate the target driving voltage EVDDgoal according to Equation 1.

Referring to FIGS. 7 and 8, the controller 140 may sample the voltage of the second node N2 of the driving transistor DRT four times during the fourth period T4. In contrast, the controller 140 may sample the voltage of the second node N2 of the driving transistor DRT at shorter time intervals, more times.

By sampling the voltage of the second node N2 of the driving transistor DRT at shorter intervals more times, it is possible to more precisely be aware of the specific time t=T when the driving region of the driving transistor DRT switches from the saturation region to the triode region.

By precise sensing, it is possible to further reduce the voltage margin of the driving voltage EVDD for driving the driving transistor DRT in the saturation region. Accordingly, it is possible to further reduce the voltage level of the driving voltage EVDD applied to the display panel 110.

In contrast, it is also possible to sample the voltage of the driving transistor DRT at longer time intervals during the same time, only three times, during the fourth period T4.

When the voltage of the second node N2 of the driving transistor DRT is sampled at longer time intervals, only three times, the voltage margin of the driving voltage EVDD for driving the driving transistor DRT in the saturation region may be slightly higher than when the voltage of the second node N2 of the driving transistor DRT is sampled four or more times, but a driving voltage EVDD with a smaller voltage margin than the voltage margin of the pre-change driving voltage EVDDold may be applied to the display panel 110.

The controller 140 may perform the multiple sampling process MSP on a plurality of subpixels SP and calculate the target driving voltage EVDDgoal based on the calculated driving voltage calculation variable.

Upon calculating the target driving voltage EVDDgoal, the controller 140 may use the smallest value among the driving voltage calculation variables of the plurality of subpixels SP.

The subpixel SP where the driving voltage calculation variable is smallest may be the subpixel SP where the variation in the voltage of the second node N2 of the driving transistor DRT over time is smallest. Such a subpixel SP may be the subpixel SP with the smallest mobility, as a result of performing the mobility sensing.

The controller 140 may perform the multiple sampling process MSP only on the subpixel SP with the smallest mobility and calculate the target driving voltage using the driving voltage calculation variable calculated in the multiple sampling process MSP on the corresponding subpixel SP.

Accordingly, the target driving voltage EVDDgoal is calculated conservatively. The display panel 110 may be stably driven.

In particular, when the voltage of the second node N2 of the driving transistor DRT is sampled at shorter time intervals multiple times during the fourth period T4, the sensed individual characteristic value of the driving transistor DRT may be reflected. In this case, it may be more effective to calculate the target driving voltage EVDDgoal conservatively.

Accordingly, the controller 140 may calculate the target driving voltage EVDDgoal.

Figure 9:
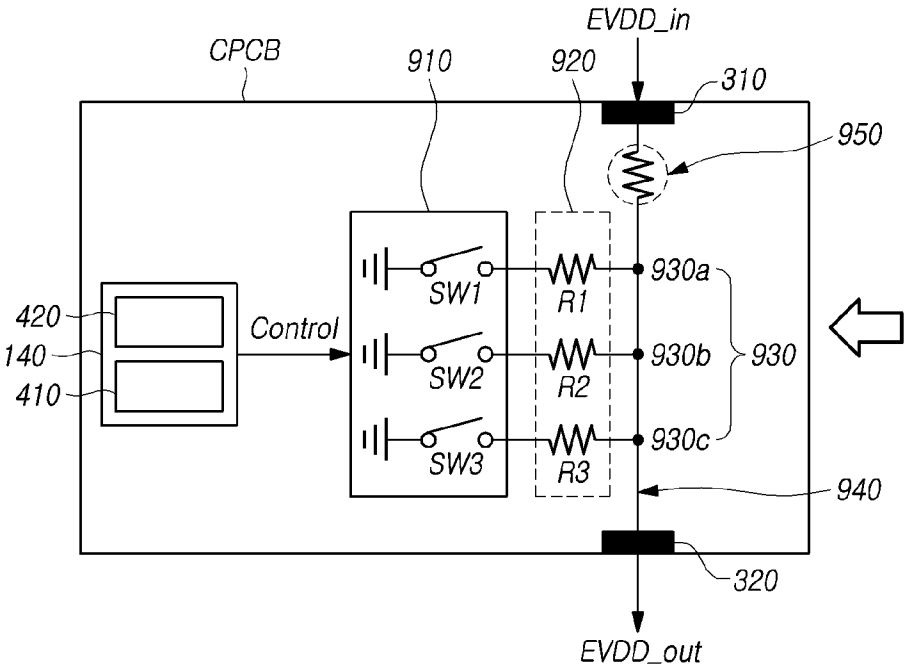
FIG. 9 is a view illustrating adjusting a voltage output from a high-potential driving voltage output terminal by a controller.

FIG. 9 is a view illustrating an example in which the controller 140 adjusts the voltage EVDD_out output from the high-potential driving voltage output terminal 320.

Referring to FIG. 9, the controller 140 may be mounted on the control printed circuit board CPCB. A switching unit 910, a resistor unit 920, a raw driving voltage input terminal 310, a high-potential driving voltage output terminal 320, and a driving voltage via line 940 may be positioned on the control printed circuit board CPCB. The above-described components may be referred to as a "driving circuit" for driving the display panel. The driving circuit may include all of the printed circuit board PCB and various circuits positioned on the printed circuit board PCB. The printed circuit board PCB may be, e.g., the control printed circuit board CPCB.

Referring to FIG. 9, the raw high-potential driving voltage EVDD_in is input to the raw high-potential driving voltage input terminal 310. The raw high-potential driving voltage EVDD_in may be output from the above-described set board.

The high-potential driving voltage output terminal 320 is electrically connected to the raw high-potential input terminal 310 through the driving voltage via line 940. A reference resistor 950 is positioned on the driving voltage via line 940.

The resistor unit 920 may be electrically connected to the via line 940. The resistor unit 920 may include at least one resistor R.

The resistor R includes one end electrically connected to a raw driving voltage dividing node 930 and the other end electrically connected to the switching unit 910.

The switching unit 910 includes a switching element SW for switching the connection between the resistor unit 920 and a low-potential power source. A ground level voltage may be supplied from the low-potential power source.

Referring to FIG. 9, the resistor unit 920 may include two or more resistors R having different resistances. The switching unit 910 may include the same number of switching elements SW as the number of resistors R included in the resistance unit 920. When the resistor unit 920 includes two or more resistors R, the two or more resistors R are connected in parallel to the driving voltage via line 940.

For example, the resistor unit 920 may include three resistors R1, R2, and R3 having different resistances. Among the three resistors R1, R2, and R3, a first resistor R1 may have the largest resistance, and a third resistor may have the smallest resistance. The resistances of the three resistors R1, R2, and R3 may meet R1>R2>R3.

The switching unit 910 may include three switching elements SW1, SW2, and SW3 for switching electrical connection between the three resistors R1, R2, and R3, respectively, and the low-potential power source.

The controller 140 may control the switching unit 910.

The switching unit 910 may be included in a power management circuit which be mounted on the control printed circuit board CPCB. In this case, the controller 140 may control the switching unit 910 in an I2C communication scheme.

According to the operation of the three switching elements SW1, SW2, and SW3 included in the switching unit 910, the magnitudes of the voltages applied to the respective raw driving voltage dividing nodes 930*a*, 930*b*, and 930*c* of the three resistors R1, R2, and R3 vary.

Accordingly, the voltage level of the voltage output from the high-potential driving voltage output terminal 320 may be reduced.

The controller 140 controls the switching unit 910 so that the voltage level of the voltage output from the high-potential driving voltage output terminal 320 is reduced to a range closest to the above-described target driving voltage EVDDgoal.

For example, the controller 140 may control the switching unit 910 including the three switching elements SW1, SW2, and SW3. Accordingly, the controller 140 may finely adjust the voltage output from the high-potential driving voltage output terminal 320 to eight separate steps EVDD_1 to EVDD_8.

The controller 140 divides the voltage output from the high-potential driving voltage output terminal 320 into the eight stages EVDD_1 to EVDD_8 and may control the switching unit 910 so that the voltage closest to the target driving voltage EVDDgoal in a range equal to or larger than the target driving voltage EVDDgoal is output from the high-potential driving voltage output terminal 320.

Thus, the high-potential driving voltage output terminal 320 may output the high-potential driving voltage EVDD_out whose voltage level is lower than that of the raw high-potential driving voltage EVDD_in. The high-potential driving voltage EVDD_out has a value closest to the target driving voltage EVDDgoal in a range equal to or larger than the target driving voltage EVDDgoal, and an appropriate margin for the driving voltage EVDD may be secured.

When the multiple sampling process MSP is performed as an off-sensing process performed before an off-sequence, such as power-off, the controller 140 may control the switching unit 910 when the display device is turned on for the first time since power supply to the display device has been cut off.

In other words, the voltage level of the high-potential driving voltage EVDD_out output from the high-potential driving voltage output terminal 320 before the off-sequence may differ from the voltage level of the high-potential driving voltage EVDD_out when the display device is turned on for the first time after the multiple sampling process MSP.

Figure 10:
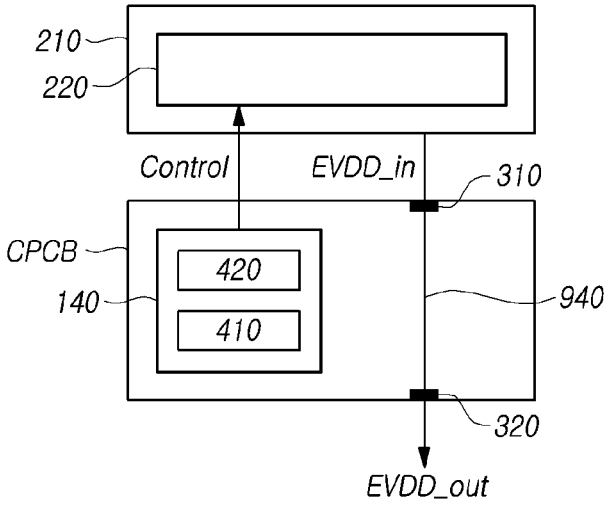
FIG. 10 is a view illustrating adjusting a voltage input to a raw high-potential driving voltage input terminal by a controller.

FIG. 10 is a view illustrating an example in which the controller 140 adjusts the voltage EVDD_in input to the raw high-potential driving voltage input terminal 310.

Referring to FIG. 10, the controller 140 may control the main power management circuit 220 included in the set board 210.

When the controller 140 is mounted on the control printed circuit board CPCB, and the main power management circuit 220 is mounted on the set board 210, the controller 140 may control the main power management circuit 220 to reduce the voltage level of the raw high-potential driving voltage EVDD_in output from the set board 210 through the I2C communication scheme.

The set board 210 may output the raw high-potential driving voltage EVDD_in having a lower voltage level than pre-change the driving voltage EVDDold under the control of the controller 140.

The voltage level of the raw high-potential driving voltage EVDD_in output from the set board 210 may be equal to, e.g., the voltage level of the target driving voltage EVDDgoal.

The raw high-potential driving voltage input terminal 310 receives the raw high-potential driving voltage EVDD_in having a reduced voltage level and outputs it to the high-potential driving voltage output terminal 320 through the driving voltage via line 940.

The high-potential driving voltage output terminal 320 outputs the high-potential driving voltage EVDD_out to the display panel.

Accordingly, it is possible to apply the driving voltage EVDD whose voltage level has been reduced to an appropriate level.

Accordingly, it is possible to reduce power consumption by decreasing the voltage level of the raw high-potential driving voltage EVDD_in output from the set board 210.

When the multiple sampling process MSP is performed as an off-sensing process performed before an off-sequence, such as power-off, the controller 140 may control the main power management circuit 220 when the display device is turned on for the first time since power supply to the display device has been cut off.

In other words, the voltage level of the raw high-potential driving voltage EVDD_in input to the raw high-potential driving voltage input terminal 310 before the off-sequence may differ from the voltage level of the raw high-potential driving voltage EVDD_in when the display device is turned on for the first time after the multiple sampling process MSP.

Figure 11:
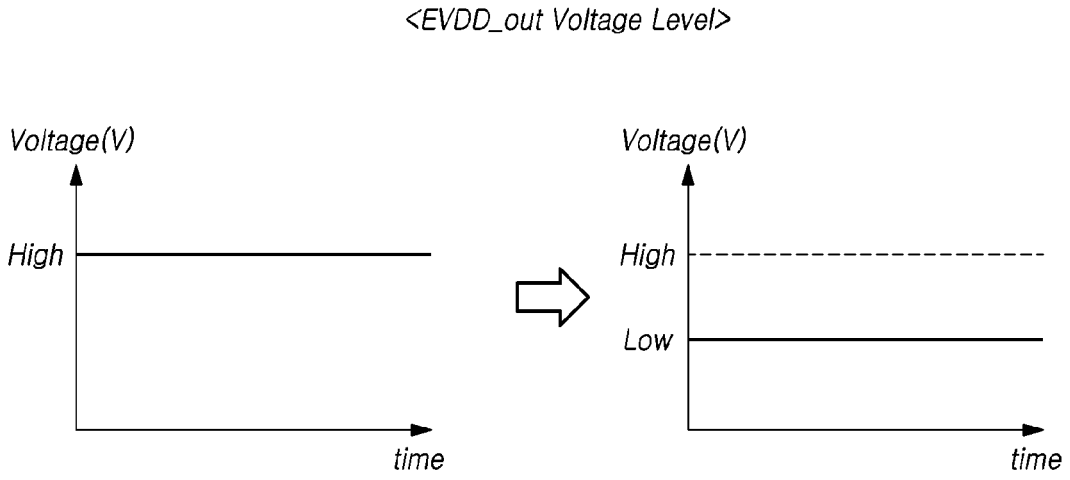
FIG. 11 is a view illustrating a decrease in high-potential driving voltage in a display device according to the disclosure.

FIG. 11 is a view illustrating a decrease in high-potential driving voltage EVDD_out in a display device according to the disclosure.

The display device according to the disclosure may reduce the voltage level of the high-potential driving voltage EVDD_out output from the high-potential driving voltage output terminal.

The display device according to the disclosure may reduce the voltage level of the driving voltage EVDD by sampling the voltage of the second node N2 of the driving transistor DRT three or more times during the multiple sampling process MSP period and calculate the target driving voltage EVDDgoal capable of driving the driving transistor DRT in the saturation region.

The display device according to the disclosure may calculate the target driving voltage EVDDgoal for stably driving the display panel by performing the multiple sampling process MSP on the plurality of subpixels SP.

The display device according to the disclosure may decrease the voltage level of the raw high-potential driving voltage EVDD_in input to the raw high-potential driving voltage input terminal and input the high-potential driving voltage EVDD_out whose voltage level has been reduced close to the target driving voltage EVDDgoal to the display panel.

The display device according to the disclosure may reduce the voltage level of the raw high-potential driving voltage EVDD_in to the voltage level of the target driving voltage EVDDgoal.

Accordingly, it is possible to adaptively reduce the voltage level of the driving voltage EVDD based on the state of the display panel.

By adaptively reduce the voltage level of the driving voltage EVDD based on the state of the display panel, it is possible to prevent steady application, to the driving transistor, of the driving voltage EVDD having a higher voltage level than is necessary. Therefore, it is possible to mitigate a change in the characteristic value of the driving transistor DRT.

The foregoing aspects are briefly described below.

Aspects of the disclosure may provide a display device 100 comprising a display panel 110 including a plurality of gate lines GL, a plurality of subpixels SP, and a plurality of reference voltage lines RVL electrically connected with the plurality of subpixels SP, each of the plurality of subpixels SP including a driving transistor DRT and a light emitting element ED and a gate driving circuit 130 configured to supply a gate signal Vgate to the plurality of gate lines GL, wherein there are three or more periods during which a voltage change slope of a reference voltage line RVL electrically connected with any one subpixel SP of the plurality of subpixels SP is decreased and then restored while the gate driving circuit 130 applies the gate signal Vgate of a turn-on level voltage to the any one subpixel SP.

For example, a case in which there are three recovery periods after the voltage change slope (e.g., voltage rising slope or voltage falling slope) of the reference voltage line RVL decreases will be described in detail as follows. For example, the voltage of the reference voltage line RVL may change according to the first voltage change slope, and then may not change or may change with a voltage change slope smaller than the first voltage change slope during a first period. Thereafter, the voltage of the reference voltage line RVL may change again with the first voltage change slope, and then may not change or may change with a voltage change slope smaller than the first voltage change slope during a second period. Thereafter, the voltage of the reference voltage line RVL may change again with the first voltage change slope, and then may not change or may change with a voltage change slope smaller than the first voltage change slope during a third period.

Aspects of the disclosure may provide the display device 100 further comprising a data driving circuit 120 including an initialization switch SPRE configured to switch an electrical connection between each of the plurality of reference voltage lines RVL and a reference voltage supply node Nref, an analog-to-digital converter ADC configured to sample a voltage of the plurality of reference voltage lines RVL, and a sampling switch SAM configured to switch an electrical connection between the analog-to-digital converter ADC and each of the plurality of reference voltage lines RVL, wherein when the sampling switch SAM is turned on and then turned off, the voltage change slope of the reference voltage line RVL electrically connected with the sampling switch SAM is decreased and then restored, and wherein when the voltage change slope of the reference voltage line RVL at a specific sampling time after a second sampling time among three or more times of sampling while the data driving circuit 120 samples the voltage of the reference voltage line RVL three or more times is different from the voltage change slope of the reference voltage line RVL immediately before sampling at the specific sampling time, a voltage level of a high-potential driving voltage EVDD_out applied to the display panel 110 is varied depending on a voltage applied to the reference voltage line RVL at a sampling time immediately before the specific sampling time.

Aspects of the disclosure may provide the display device 100 further comprising a controller 140 configured to drive the gate driving circuit 130 and the data driving circuit 120, wherein from the second sampling time SAM 2nd where second sampling among the three or more times of sampling is performed, the controller 140 calculates the voltage change slope of the reference voltage line RVL at a corresponding sampling time from a voltage difference between a voltage sampled at the corresponding sampling time and a voltage sampled at a sampling time immediately before and compares the voltage change slope of the reference voltage line RVL after the third sampling time SAM 3rd among the three or more times of sampling with the voltage change slope of the reference voltage line RVL at the second sampling time SAM 2nd, and wherein the voltage level of the high-potential driving voltage EVDD_out applied to the display panel 110 is decreased according to a result of the comparison.

Aspects of the disclosure may provide the display device 100, wherein when the voltage change slope of the reference voltage line RVL at the specific sampling time is smaller than the voltage change slope of the reference voltage line RVL at the second sampling time SAM 2nd, the controller 140 is configured to calculate a target driving voltage EVDDgoal based on the voltage of the reference voltage line RVL sampled at the sampling time immediately before the specific sampling time.

Aspects of the disclosure may provide the display device 100, wherein each of the plurality of subpixels SP further includes a scan transistor SCT configured to be controlled by a scan pulse SCAN of the gate signal Vgate and configured to transfer a data voltage, supplied from one of the plurality of data lines DL included in the display panel 110, to a first node N1 of the driving transistor DRT, a sensing transistor SENT configured to be controlled by a sense pulse SENSE of the gate signal Vgate and configured to switch an electrical connection between a second node N2 of the driving transistor DRT and the reference voltage line RVL, and a storage capacitor Cst including a first end electrically connected to the first node N1 of the driving transistor DRT and second end electrically connected to the second node N2 of the driving transistor DRT, wherein the second node N2 of the driving transistor DRT is electrically connected with a first electrode of the light emitting element ED, wherein a third node N3 of the driving transistor DRT is electrically connected with a driving voltage line DVL, wherein a driving voltage for operating the driving transistor DRT and driving the light emitting element ED is applied to the driving voltage line DVL.

Aspects of the disclosure may provide the display device 100 further comprising a controller 140 configured to drive the gate driving circuit 130 and the data driving circuit 120, wherein the display device 100 has a multiple sampling process period during which a multiple sampling process MSP is performed to sample the voltage of the reference voltage line RVL three or more times, wherein the multiple sampling process period includes a first period T1, a second period T2, a third period T3, and a fourth period T4, wherein during the first period T1, the sense pulse SENSE of the turn-on level voltage is applied to the sensing transistor SENT, the initialization switch SPRE is turned on, and a voltage of a second node N2 of the driving transistor DRT is initialized to a reference voltage Vref, wherein during the second period T2, the scan pulse SCAN of the turn-on level voltage is applied to the scan transistor SCT, and a data voltage Vdata is applied to the plurality of data line DL, wherein during the third period T3, the scan transistor SCT is turned off, and wherein during the fourth period T4, the initialization switch SPRE is turned off, the voltage of the second node N2 of the driving transistor DRT is increased, and while the voltage of the second node N2 is increased, the sampling switch SAM is switched three or more times.

Aspects of the disclosure may provide the display device 100, wherein the controller 140 is configured to calculate a voltage change slope of the second node N2 of the driving transistor DRT at a sampled time based on a sampled voltage value of the second node N2 of the driving transistor DRT and store a voltage value sampled immediately before the voltage change slope is decreased, as a driving voltage calculation variable.

Aspects of the disclosure may provide the display device 100, wherein the controller 140 is configured to calculate and store the driving voltage calculation variable for each of the plurality of subpixels SP.

Aspects of the disclosure may provide the display device 100, wherein the controller 140 is configured to calculate a target driving voltage EVDDgoal using a smallest value among the driving voltage calculation variables calculated for respective ones of the plurality of subpixels SP.

Aspects of the disclosure may provide the display device 100 further comprising a controller 140 configured to drive the gate driving circuit 130, wherein the controller 140 is configured to control the gate driving circuit 130 to supply a gate signal Vgate of the turn-on level voltage to a subpixel SP with a smallest mobility among the plurality of subpixels SP, and wherein a voltage change slope of a reference voltage line RVL electrically connected with the subpixel SP with the smallest mobility is decreased three or more times and then restored.

Aspects of the disclosure may provide the display device 100, wherein for each of the three periods during which the voltage change slope of the reference voltage line RVL is decreased and then restored, a voltage rise width per unit time of the reference voltage line RVL before the voltage change slope of the reference voltage line RVL is decreased is equal to a voltage rise width per unit time of the reference voltage line RVL after the voltage change slope of the reference voltage line RVL is restored.

Aspects of the disclosure may provide the display device 100 further comprising a driving circuit configured to drive the display panel 110, wherein the driving circuit includes a raw high-potential driving voltage input terminal 310 to which a raw high-potential driving voltage EVDD_in is input, a high-potential driving voltage output terminal 320 outputting a high-potential driving voltage EVDD_out to the display panel 110, a driving voltage via line 940 electrically connecting the raw high-potential driving voltage input terminal 310 with the high-potential driving voltage output terminal 320, a reference resistor 950 positioned on the driving voltage via line 940, a resistor unit 920 electrically connected with the driving voltage via line 940, and a switching unit 910 configured to switch a connection between the resistor unit 920 and a low-potential power source.

Aspects of the disclosure may provide the display device 100, wherein a voltage level of the high-potential driving voltage EVDD_out is lower than a voltage level of the raw high-potential driving voltage EVDD_in.

Aspects of the disclosure may provide the display device 100, wherein the resistor unit 920 includes two or more resistors R having different resistances, wherein each of the two or more resistors R includes a first end electrically connected to the driving voltage via line 940 and a second end electrically connected to the switching unit 910, wherein each of the two or more resistors R is connected in parallel to the driving voltage via line 940, and wherein the switching unit 910 includes a same number of switching elements SW as a number of the resistors R included in the resistance unit 920.

Aspects of the disclosure may provide the display device 100, wherein the controller 140 is configured to control the switching unit 910 to decrease a voltage level of the high-potential driving voltage EVDD_out in a range of a voltage level equal to or higher than the voltage level of the target driving voltage EVDDgoal and control the switching unit 910 to minimize (or reduce) a voltage level difference between the high-potential driving voltage EVDD_out and the target driving voltage EVDDgoal.

Aspects of the disclosure may provide the display device 100 further comprising a main power management circuit 220 configured to adjust a voltage level of a raw high-potential driving voltage EVDD_in, wherein the controller 140 is configured to control the main power management circuit 220 to allow the voltage level of the raw high-potential driving voltage EVDD_in to be equal to a voltage level of the target driving voltage EVDDgoal.

Aspects of the disclosure may provide a display device 100 comprising a display panel 110 including a plurality of subpixels SP, each of the plurality of subpixels SP including a driving transistor DRT and a light emitting element ED, and a driving circuit configured to drive the display panel 110, wherein the driving circuit includes a raw high-potential driving voltage input terminal 310 to which a raw high-potential driving voltage EVDD_in is input, a high-potential driving voltage output terminal 320 outputting a high-potential driving voltage EVDD_out to the display panel 110 and outputting the high-potential driving voltage EVDD_out having a voltage level lower than the raw high-potential driving voltage EVDD_in, a driving voltage via line 940 electrically connecting the raw high-potential driving voltage input terminal 310 with the high-potential driving voltage output terminal 320, a reference resistor 950 positioned on the driving voltage via line 940, a resistor unit 920 electrically connected with the driving voltage via line 940, a switching unit 910 configured to switch an electrical connection between the resistor unit 920 and a low-potential power source, and a controller 140 configured to control the switching unit 910.

Aspects of the disclosure may provide the display device 100, wherein the driving circuit further includes a printed circuit board PCB, wherein the controller 140 is mounted on the printed circuit board PCB, and wherein the raw high-potential driving voltage input terminal 310, the high-potential driving voltage output terminal 320, the driving voltage via line 940, the reference resistor 950, the resistor unit 920, and the switching unit 910 are positioned on the printed circuit board PCB.

Aspects of the disclosure may provide the display device 100 further comprising a gate driving circuit 130 configured to supply a gate signal Vgate to the plurality of gate lines GL included in the display panel 110, wherein there are three or more periods during which a voltage change slope of a reference voltage line RVL electrically connected with any one subpixel SP of the plurality of subpixels SP is decreased and then restored while the gate driving circuit 130 applies the gate signal Vgate of a turn-on level voltage to the any one subpixel SP.

Aspects of the disclosure may provide the display device 100, wherein when a variation in voltage per unit time of the reference voltage line RVL calculated at a specific sampling time among three or more times of sampling performed on voltage of the reference voltage line is smaller than a variation in voltage per unit time of the reference voltage line RVL calculated at the second sampling time SAM 2nd of the three or more times of sampling, the controller 140 calculates a target driving voltage EVDDgoal based on the voltage of the reference voltage line RVL sampled at a sampling time immediately before the specific sampling time, and controls the switching unit 910 to decrease a voltage level of the voltage output from the high-potential driving voltage output terminal 320 in a range of a voltage level equal to or higher than the voltage level of the target driving voltage EVDDgoal.

Aspects of the disclosure may provide a display device, the display device comprises: a display panel; a controller for controlling a data driving circuit and a gate driving circuit of the display panel, wherein the controller is mounted on a control printed circuit board; and a set board electrically connected with the control printed circuit board, wherein a main power management circuit for managing overall power of the display device is disposed on the set board, wherein the control printed circuit board includes a raw high-potential driving voltage input terminal and a high-potential driving voltage output terminal, a raw high-potential driving voltage output from the set board is input to the raw high-potential driving voltage input terminal, and the high-potential driving voltage output terminal outputs a high-potential driving voltage to the display panel, and the controller controls the main power management circuit to reduce voltage level of the raw high-potential driving voltage output from the set board.

The above description has been presented to enable any person skilled in the art to make and use the technical idea of the present disclosure, and has been provided in the context of a particular application and its requirements. Various modifications, additions and substitutions to the described aspects will be readily apparent to those skilled in the art, and the general principles defined herein may be applied to other aspects and applications without departing from the spirit and scope of the present disclosure. The above description and the accompanying drawings provide an example of the technical idea of the present disclosure for illustrative purposes only. That is, the disclosed aspects are intended to illustrate the scope of the technical idea of the present disclosure. Thus, the scope of the present disclosure is not limited to the aspects shown, but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A display device, comprising:

a display panel including a plurality of gate lines, a plurality of subpixels and a plurality of reference voltage lines electrically connected with the plurality of subpixels, each of the plurality of subpixels including a driving transistor and a light emitting element; and a gate driving circuit configured to supply a gate signal to the plurality of gate lines, wherein a voltage change slope of a reference voltage line electrically connected with one subpixel of the plurality of subpixels is decreased during three or more periods and then restored while the gate driving circuit applies the gate signal of a turn-on level voltage to the one subpixel.

2. The display device of claim 1, further comprising a data driving circuit including:

an initialization switch configured to switch an electrical connection between each of the plurality of reference voltage lines and a reference voltage supply node;

an analog-to-digital converter configured to sample a voltage of the plurality of reference voltage lines; and a sampling switch configured to switch an electrical connection between the analog-to-digital converter and each of the plurality of reference voltage lines, wherein, when the sampling switch is turned on and then turned off, the voltage change slope of the reference voltage line electrically connected with the sampling switch is decreased and then restored, wherein when the voltage change slope of the reference voltage line at a specific sampling time after a second sampling time among three or more times of sampling while the data driving circuit samples the voltage of the reference voltage line three or more times is different from the voltage change slope of the reference voltage line immediately before sampling at the specific sampling time, and wherein a voltage level of a high-potential driving voltage applied to the display panel is varied depending on a voltage applied to the reference voltage line at a sampling time immediately before the specific sampling time.

3. The display device of claim 2, further comprising a controller configured to drive the gate driving circuit and the data driving circuit, wherein from the second sampling time where second sampling among the three or more times of sampling is performed, the controller calculates the voltage change slope of the reference voltage line at a corresponding sampling time from a voltage difference between a voltage sampled at the corresponding sampling time and a voltage sampled at a sampling time immediately before and compares the voltage change slope of the reference voltage line after the third sampling time among the three or more times of sampling with the voltage change slope of the reference voltage line at the second sampling time, and wherein the voltage level of the high-potential driving voltage applied to the display panel is decreased according to a result of the comparison.

4. The display device of claim 3, wherein, when the voltage change slope of the reference voltage line at the specific sampling time is smaller than the voltage change slope of the reference voltage line at the second sampling time, the controller is configured to calculate a target driving voltage based on the voltage of the reference voltage line sampled at the sampling time immediately before the specific sampling time.

5. The display device of claim 4, further comprising a driving circuit configured to drive the display panel, wherein the driving circuit includes:

a raw high-potential driving voltage input terminal to which a raw high-potential driving voltage is input;

a high-potential driving voltage output terminal outputting a high-potential driving voltage to the display panel;

a driving voltage via line electrically connecting the raw high-potential driving voltage input terminal with the high-potential driving voltage output terminal;

a reference resistor positioned on the driving voltage via line;

a resistor unit electrically connected with the driving voltage via line; and a switching unit configured to switch a connection between the resistor unit and a low-potential power source.

6. The display device of claim 5, wherein a voltage level of the high-potential driving voltage is lower than a voltage level of the raw high-potential driving voltage.

7. The display device of claim 6, wherein the resistor unit includes two or more resistors having different resistances, wherein each of the two or more resistors includes a first end electrically connected to the driving voltage via line and a second end electrically connected to the switching unit, wherein each of the two or more resistors is connected in parallel to the driving voltage via line, and wherein the switching unit includes a same number of switching elements as a number of the resistors included in the resistance unit.

8. The display device of claim 5, wherein the controller is configured to control the switching unit to decrease a voltage level of the high-potential driving voltage in a range of a voltage level equal to or higher than the voltage level of the target driving voltage and control the switching unit to minimize a voltage level difference between the high-potential driving voltage and the target driving voltage.

9. The display device of claim 4, further comprising a main power management circuit configured to adjust a voltage level of a raw high-potential driving voltage, wherein the controller is configured to control the main power management circuit to allow the voltage level of the raw high-potential driving voltage to be equal to a voltage level of the target driving voltage.

10. The display device of claim 2, wherein each of the plurality of subpixels further includes:

a scan transistor configured to be controlled by a scan pulse of the gate signal and configured to transfer a data voltage, supplied from one of a plurality of data lines included in the display device, to a first node of the driving transistor;

a sensing transistor configured to be controlled by a sense pulse of the gate signal and configured to switch an electrical connection between a second node of the driving transistor and the reference voltage line; and a storage capacitor including a first end electrically connected to the first node of the driving transistor and second end electrically connected to the second node of the driving transistor, wherein the second node of the driving transistor is electrically connected with a first electrode of the light emitting element, wherein a third node of the driving transistor is electrically connected with a driving voltage line, and wherein a driving voltage for operating the driving transistor and driving the light emitting element is applied to the driving voltage line.

11. The display device of claim 10, further comprising a controller configured to drive the gate driving circuit and the data driving circuit, wherein the display device has a multiple sampling process period during which a multiple sampling process is performed to sample the voltage of the reference voltage line three or more times, wherein the multiple sampling process period includes a first period, a second period, a third period, and a fourth period, wherein during the first period, the sense pulse of the turn-on level voltage is applied to the sensing transistor, the initialization switch is turned on, and a voltage of the second node of the driving transistor is initialized to a reference voltage, wherein during the second period, the scan pulse of the turn-on level voltage is applied to the scan transistor, and a data voltage is applied to the plurality of data line, wherein during the third period, the scan transistor is turned off, and wherein during the fourth period, the initialization switch is turned off, the voltage of the second node of the driving transistor is increased, and while the voltage of the second node is increased, the sampling switch is switched three or more times.

12. The display device of claim 11, wherein the controller is configured to calculate a voltage change slope of the second node of the driving transistor at a sampled time based on a sampled voltage value of the second node of the driving transistor and store a voltage value sampled immediately before the voltage change slope is decreased, as a driving voltage calculation variable.

13. The display device of claim 12, wherein the controller is configured to calculate and store the driving voltage calculation variable for each of the plurality of subpixels.

14. The display device of claim 13, wherein the controller is configured to calculate a target driving voltage using a smallest value among the driving voltage calculation variables calculated for respective ones of the plurality of subpixels.

15. The display device of claim 1, further comprising a controller configured to drive the gate driving circuit, wherein the controller is configured to control the gate driving circuit to supply a gate signal of the turn-on level voltage to a subpixel with a smallest mobility among the plurality of subpixels, and wherein a voltage change slope of the reference voltage line electrically connected with the subpixel with the smallest mobility is decreased three or more times and then restored.

16. The display device of claim 1, wherein for each of the three periods during which the voltage change slope of the reference voltage line is decreased and then restored, a voltage rise width per unit time of the reference voltage line before the voltage change slope of the reference voltage line is decreased is equal to a voltage rise width per unit time of the reference voltage line after the voltage change slope of the reference voltage line is restored.

17. A display device, comprising:

a display panel including a plurality of subpixels, each of the plurality of subpixels including a driving transistor and a light emitting element; and a driving circuit configured to drive the display panel, wherein the driving circuit includes:

a raw high-potential driving voltage input terminal to which a raw high-potential driving voltage is input;

a high-potential driving voltage output terminal outputting a high-potential driving voltage to the display panel and outputting the high-potential driving voltage having a voltage level lower than the raw high-potential driving voltage;

a driving voltage via line electrically connecting the raw high-potential driving voltage input terminal with the high-potential driving voltage output terminal;

a reference resistor positioned on the driving voltage via line;

a resistor unit electrically connected with the driving voltage via line;

a switching unit configured to switch an electrical connection between the resistor unit and a low-potential power source; and a controller configured to control the switching unit.

18. The display device of claim 17, wherein the driving circuit further includes a printed circuit board, wherein the controller is mounted on the printed circuit board, and wherein the raw high-potential driving voltage input terminal, the high-potential driving voltage output terminal, the driving voltage via line, the reference resistor, the resistor unit, and the switching unit are positioned on the printed circuit board.

19. The display device of claim 18, further comprising a gate driving circuit configured to supply a gate signal to a plurality of gate lines included in the display device, wherein a voltage change slope of a reference voltage line electrically connected with any one subpixel of the plurality of subpixels is decreased during three or more periods and then restored while the gate driving circuit applies the gate signal of a turn-on level voltage to the any one subpixel.

20. The display device of claim 19, wherein, when a variation in voltage per unit time of the reference voltage line calculated at a specific sampling time among three or more times of sampling performed on voltage of the reference voltage line is smaller than a variation in voltage per unit time of the reference voltage line calculated at a second sampling time of the three or more times of sampling, and wherein the controller calculates a target driving voltage based on the voltage of the reference voltage line sampled at a sampling time immediately before the specific sampling time, and controls the switching unit to decrease a voltage level of the voltage output from the high-potential driving voltage output terminal in a range of a voltage level equal to or higher than the voltage level of the target driving voltage.

* * * * *